US012031383B2

(12) United States Patent
Maouche et al.

(10) Patent No.: US 12,031,383 B2
(45) Date of Patent: Jul. 9, 2024

(54) SHAPED CUTTER ARRANGEMENTS

(71) Applicant: Halliburton Energy Services, Inc., Houston, TX (US)

(72) Inventors: Zakaria Maouche, The Woodlands, TX (US); Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 330 days.

(21) Appl. No.: 17/309,838

(22) PCT Filed: Mar. 7, 2019

(86) PCT No.: PCT/US2019/021199

§ 371 (c)(1),
(2) Date: Jun. 22, 2021

(87) PCT Pub. No.: WO2020/180330

PCT Pub. Date: Sep. 10, 2020

(65) Prior Publication Data

US 2022/0074270 A1 Mar. 10, 2022

(51) Int. Cl.
*E21B 10/43* (2006.01)
*E21B 10/567* (2006.01)

(52) U.S. Cl.
CPC ..... *E21B 10/43* (2013.01); *E21B 10/5673* (2013.01)

(58) Field of Classification Search
CPC ..... E21B 10/43; E21B 10/5673; E21B 10/34; E21B 10/327
See application file for complete search history.

(56) References Cited

U.S. PATENT DOCUMENTS 4,673,044 A * 6/1987 Bigelow ..... E21B 10/5673 175/339
4,858,707 A * 8/1989 Jones ..... E21B 10/5673 175/431
4,872,520 A * 10/1989 Nelson ..... E21B 10/60 175/430
4,932,484 A * 6/1990 Warren ..... E21B 10/43 175/398
5,021,675 A 6/1991 Fischer
5,332,051 A * 7/1994 Knowlton ..... E21B 10/5673 175/430

(Continued)

FOREIGN PATENT DOCUMENTS

WO 2018033549 A1 2/2018

OTHER PUBLICATIONS

PCT Application Serial No. PCT/US2019/021199, International Search Report, mailed Dec. 6, 2019, 4 pages.

(Continued)

*Primary Examiner* — Steven A MacDonald
(74) *Attorney, Agent, or Firm* — DeLizio, Peacock, Lewin & Guerra, LLP

(57) ABSTRACT

A device includes a drill bit body defining an axis of rotation, a plurality of drill blades on the drill bit body, and a shaped cutter secured to at least one of the plurality of drill blades. The shaped cutter including an engagement surface having an exposed partially flattened boundary, wherein a contact point of the engagement surface during drilling is off-centered with respect to a center of the exposed partially flattened boundary.

17 Claims, 14 Drawing Sheets

(56) References Cited

U.S. PATENT DOCUMENTS 5,467,836 A * 11/1995 Grimes ..... E21B 10/5673 175/401
5,497,842 A * 3/1996 Pastusek ..... E21B 10/43 175/391
5,607,024 A * 3/1997 Keith ..... E21B 10/43 175/431
5,649,604 A * 7/1997 Fuller ..... E21B 10/43 175/431
5,651,421 A * 7/1997 Newton ..... E21B 10/55 175/431
5,871,391 A 2/1999 Pryor
5,873,422 A * 2/1999 Hansen ..... E21B 10/43 175/426
5,937,958 A * 8/1999 Mensa-Wilmot ..... E21B 7/068 175/398
5,992,548 A * 11/1999 Silva ..... E21B 10/55 175/391
6,003,623 A * 12/1999 Miess ..... E21B 10/5735 175/428
6,068,071 A * 5/2000 Jurewicz ..... E21B 10/5735 175/434
6,123,160 A * 9/2000 Tibbitts ..... E21B 10/46 175/406
6,125,947 A * 10/2000 Trujillo ..... E21B 10/55 175/57
6,164,394 A * 12/2000 Mensa-Wilmot ..... E21B 10/567 175/431
6,164,395 A * 12/2000 Fuller ..... E21B 10/55 175/431
6,246,974 B1 * 6/2001 Jelley ..... E21B 10/43 702/9
6,298,930 B1 * 10/2001 Sinor ..... E21B 10/573 175/428
6,332,503 B1 12/2001 Pessier et al.
6,695,073 B2 * 2/2004 Glass ..... E21B 10/16 702/9
6,729,420 B2 * 5/2004 Mensa-Wilmot ..... E21B 10/26 175/385
6,904,983 B2 * 6/2005 Thigpen ..... E21B 10/5673 175/428
7,455,126 B2 * 11/2008 Cruz ..... E21B 10/46 175/420.1
7,546,888 B2 * 6/2009 Cruz ..... E21B 10/40 175/414
7,726,419 B2 * 6/2010 Cruz ..... E21B 10/56 175/430
8,374,835 B2 2/2013 Lind et al.
8,738,342 B2 5/2014 Lind et al.
8,760,668 B1 6/2014 Wiggins et al.
10,316,590 B2 * 6/2019 Maouche ..... B24D 18/00
10,794,118 B2 * 10/2020 Azar ..... E21B 10/5673
11,719,050 B2 * 8/2023 Russell ..... E21B 10/5673 175/428
2001/0020551 A1 * 9/2001 Taylor ..... E21B 10/43 175/57
2002/0069725 A1 * 6/2002 Watson ..... E21B 10/26 76/108.2
2002/0112897 A1 * 8/2002 Chaves ..... E21B 10/5673 175/430
2005/0269139 A1 * 12/2005 Shen ..... E21B 10/5673 175/426
2006/0162968 A1 * 7/2006 Durairajan ..... E21B 10/54 175/426
2007/0078632 A1 * 4/2007 Shen ..... E21B 10/55 703/1
2007/0144789 A1 * 6/2007 Johnson ..... G06F 30/00 175/431
2007/0278014 A1 * 12/2007 Cariveau ..... E21B 10/42 175/398
2008/0156542 A1 7/2008 Baker et al.
2008/0179106 A1 * 7/2008 Gavia ..... E21B 10/43 175/434
2008/0296070 A1 * 12/2008 Shen ..... E21B 10/5673 76/108.4
2009/0057031 A1 * 3/2009 Patel ..... E21B 10/5673 175/420.2
2009/0321139 A1 * 12/2009 Strachan ..... E21B 7/064 175/426
2010/0012384 A1 1/2010 Luce
2010/0025121 A1 * 2/2010 Schwefe ..... E21B 10/43 175/431
2010/0089661 A1 * 4/2010 Welch ..... E21B 10/43 175/428
2010/0326742 A1 * 12/2010 Vempati ..... E21B 10/43 175/431
2011/0155472 A1 * 6/2011 Lyons ..... E21B 10/55 76/108.1
2011/0266070 A1 * 11/2011 Scott ..... E21B 10/46 175/428
2011/0278073 A1 * 11/2011 Gillis ..... E21B 10/43 175/426
2011/0284293 A1 * 11/2011 Shen ..... E21B 10/573 175/338
2012/0031674 A1 * 2/2012 Lyons ..... C22C 29/08 175/57
2013/0015000 A1 * 1/2013 Zhang ..... E21B 10/56 175/428
2013/0112485 A1 * 5/2013 Richert ..... E21B 10/02 175/428
2013/0277120 A1 * 10/2013 Azar ..... E21B 10/26 175/403
2014/0151133 A1 * 6/2014 Simmons ..... E21B 10/46 175/431
2015/0047912 A1 * 2/2015 Pettiet ..... E21B 10/62 175/428
2015/0142406 A1 5/2015 Spencer et al.
2015/0275584 A1 * 10/2015 Mensa-Wilmot ... E21B 10/5673 175/431
2016/0230472 A1 8/2016 Bilen et al.
2017/0032061 A1 2/2017 Izbinski et al.
2018/0179825 A1 * 6/2018 Johnson ..... E21B 10/60
2018/0328117 A1 * 11/2018 Bird ..... B22F 7/06
2018/0355672 A1 * 12/2018 De Maindreville ..... E21B 10/5673
2019/0071933 A1 * 3/2019 Gan ..... E21B 10/5671
2020/0011137 A1 * 1/2020 Maurstad ..... E21B 10/43
2021/0172258 A1 * 6/2021 Graham ..... E21B 10/55
2021/0180409 A1 * 6/2021 Davila ..... E21B 10/5735
2021/0180410 A1 * 6/2021 Yu ..... E21B 10/43
2022/0251905 A1 * 8/2022 Duffy ..... E21B 10/5676
2022/0307325 A1 * 9/2022 Eyre ..... E21B 10/5676
2022/0403704 A1 * 12/2022 Russell ..... E21B 10/5673
2023/0028472 A1 * 1/2023 Atkins ..... E21B 10/5673
2024/0003193 A1 * 1/2024 Song ..... E21B 10/5673

OTHER PUBLICATIONS

PCT Application Serial No. PCT/US2019/021199, International Written Opinion, mailed Dec. 6, 2019, 5 pages.

* cited by examiner

SHAPED CUTTER ARRANGEMENTS

BACKGROUND

The disclosure generally relates to the field of drilling, and more particularly to increasing drilling efficiency during drilling.

Various applications in exploration, resource acquisition, construction, and storage may benefit from drilling boreholes into a volume of solid material, such as rock or ice in the subsurface of the Earth. A common method of generating and lengthening these holes is to extend an arm with a drill bit into the hole and mill away the solid material using the drill bit. Once generated in an appropriate region, these holes provide access to previously inaccessible resources, such as hydrocarbons, water, or minerals.

A drill bit includes a drill bit body and a set of cutters, wherein the cutters include one or more mechanically stiff elements such as a polycrystalline diamond compact (PDC) table layered on a carbide bed. Cutters can be positioned around the drill bit body and at the end of the drill bit body. During drilling, physical contact between the cutters the material being drilled increases the borehole length and/or width.

BRIEF DESCRIPTION OF THE DRAWINGS

Embodiments of the disclosure may be better understood by referencing the accompanying drawings.

DESCRIPTION

Figure 1:
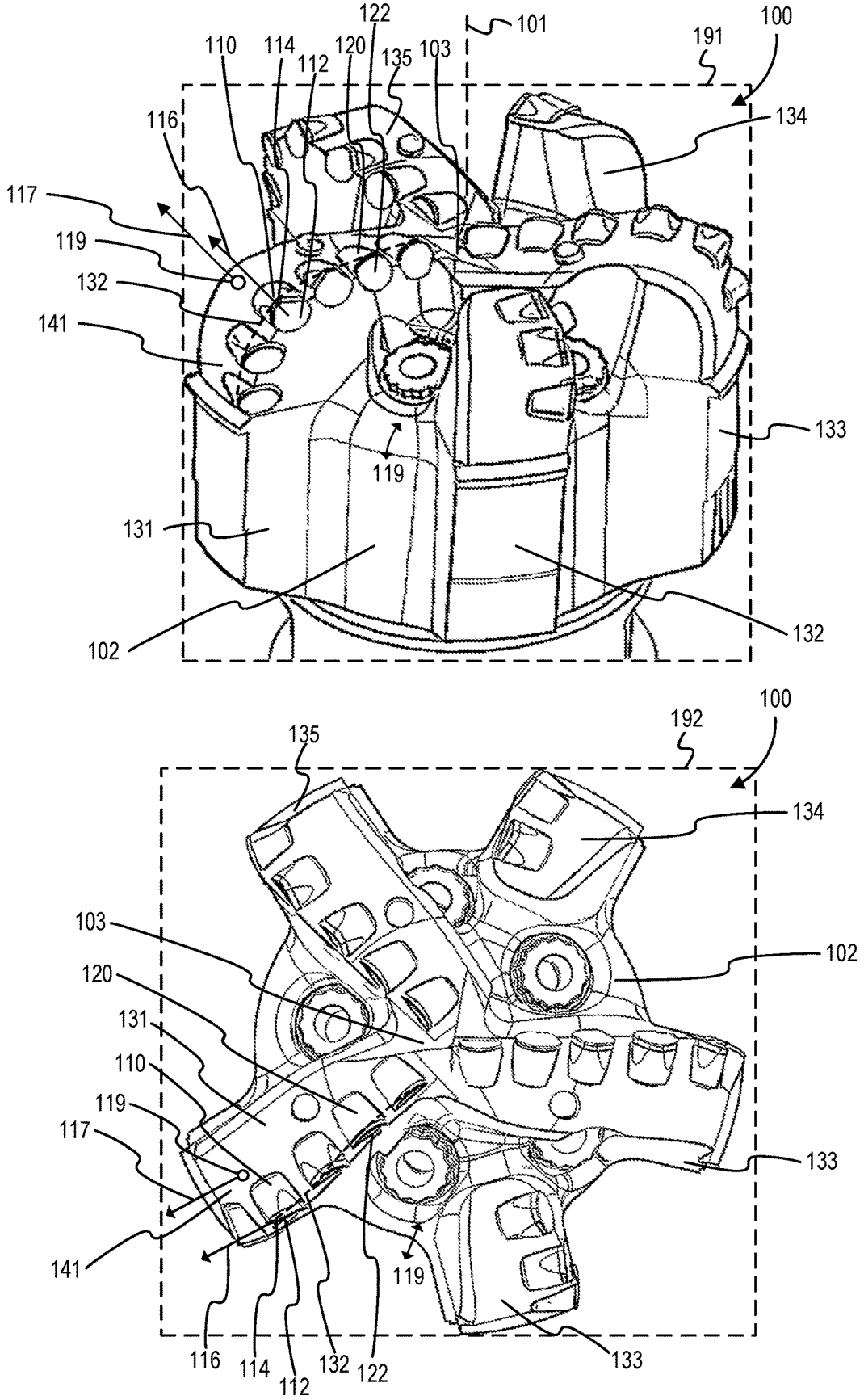
FIG. 1 includes an isometric view of a drill bit and a top view of the same drill bit.

The description that follows includes example systems, methods, techniques, and program flows that embody embodiments of the disclosure. However, it is understood that this disclosure can be practiced without these specific details. For instance, this disclosure refers to shaped cutters having a partially flattened boundary in illustrative examples. Aspects of this disclosure can be instead applied to other shaped cutters, such as a shaped cutter having multiple partially flattened boundaries, a shaped cutter having a star-shaped boundary, etc. In other cases, well-known instruction instances, protocols, structures and techniques have not been shown in detail in order not to obfuscate the description.

Various embodiments may relate to an apparatus having a tilted shaped cutter on a drill bit and a method for use of the drill bit. A shaped cutter can include a sharp-edged drill bit cutter that has an engagement surface, wherein at least a portion of the engagement surface boundary is exposed and flattened/partially flattened. In some embodiments, the engagement surface of the shaped cutter can be engaged with the material being drilled through during a drilling operation, though can also be unengaged based on a cutter orientation of its corresponding cutter and/or when its corresponding cutter is active during the drilling operation. The exposed partially flattened boundary can be flatter than another boundary segment of the same shaped cutter and can be either straight or semi-curved. The system tilts the shaped cutter until a contact point of the shaped cutter is off-centered with respect to a center of the exposed partially flattened boundary. The shaped cutter can be used on a drill bit to increase drilling efficiency during a drilling operation. However, the force applied to an area of engagement on the shaped cutters can degrade the shaped cutters.

By tilting the shaped cutter about a center of the engagement surface, stresses facing the first cutter can be redistributed to reduce cutter degradation and increase the lifespan of the shaped cutter. Specifically, a shaped cutter can be tilted over a specific orientation range relative to a cutter reference vector to form a tilted shaped cutter that changes the area of engagement between the shaped cutter and the material being drilled. The stresses experienced at the new contact point after tilting can be off-centered, which can re-distribute stress to a more durable edge of the partially flattened boundary. In some embodiments, the cutter reference vector can be a drill blade normal vector at the same axial and radial position as a portion of the tilted shaped cutter.

The orientation range available for the tilt of a tilted shaped cutter can limit the tilt of a cutter centerline at the center of the exposed partially flattened boundary, wherein the cutter centerline can be a vector that is perpendicular to a boundary of the engagement surface, bisects the boundary of the engagement surface, and is co-planar with the engagement surface. In a tilted shaped cutter, the cutter centerline is at a different angle and thus not parallel with a cutter reference vector, wherein the cutter reference vector can be determined based on a drill blade normal vector that is normal to a drill blade point on the drill blade surface, wherein the drill blade point includes a same axial position and/or radial position as a portion of the tilted shaped cutter.

In some embodiments, the tilted shaped cutters can be arranged to have a leading tilted bit cutter and at least one trailing tilted bit cutter, wherein at least a portion of the trailing tilted bit cutter is at the same axial position as a portion of the leading tilted bit cutter. The leading and trailing bit cutters can have an alternating arrangement, wherein the contact points of the leading and trailing bit cutters can be at different axial positions. In addition, the contact point can be at a lower end of the leading shaped cutter and the trailing contact point can be at an upper end of the trailing shaped cutter, wherein the lower and upper ends are provided with respect to their axial positions on an axis of rotation. Such an arrangement can cause the tilt of the trailing bit cutter to be different from the tilt of the leading bit cutter, wherein the cutter centerlines of the leading bit cutter and the trailing bit cutter can be non-parallel to the respective cutter reference vectors of the leading bit cutter and the trailing bit cutter. Alternatively, or in addition, the shaped cutters can have a step profile arrangement as described further for FIG. 8 below, wherein a first shaped cutter and a second shaped cutter on a drill bit have parallel cutter centerlines and are an equal distance from a drill bit axis, and wherein at least a portion of the second shaped cutter is at a different axial position along the axis of rotation than the first shaped cutter.

Modifying the arrangement of one or more tilted shaped cutters can reduce the rate of degradation achieved during a drilling operation. The reduced degradation and increased cutting efficiency can likewise increase drilling efficiency. The increase in drilling efficiency can reduce time and material costs used to replace degraded drill bits and increase safety during a drilling operation.

Example Drill Bits

FIG. 1 includes an isometric view of a drill bit and a top view of the same drill bit. The dashed box 191 has an isometric view of a drill bit 100 and the dashed box 192 includes a top view of the same drill bit 100. The drill bit 100 is adapted for drilling through formations of rock to generate a borehole. Drill bit 100 includes a bit axis 101 and a bit face 103 formed on the end of the drill bit 100 that supports cutting structures, wherein the bit axis 101 can also be known as an axis of rotation. As shown in this example, the drill bit 100 includes five angularly spaced-apart drill blades 131-135, which can be integrally formed as part of, and which extend from, a bit body 102. The drill blades 131-135 extend radially across the bit face 103 and longitudinally along a portion of the periphery of the drill bit 100. It should be understood that as used herein, the term "radial" or "radially" refers to positions or movement along an axis that is substantially perpendicular to the bit axis 101. In addition, it should be understood that as used herein, the term "axial," "axially", or "longitudinally" refers to positions or movement generally along an axis that is parallel to bit axis 101. Furthermore, it should be noted that as used herein, the terms "downhole," "lower," "bottom," and "bottom-facing" refers to a direction in the direction of drilling, the terms "uphole," "upper," and "upward" refer to a direction opposite to the direction of drilling, and "outward-facing" refers to any direction away from the bit body 102 of the drill bit 100.

The drill blades 131-135 include bit cutters mounted on the drill blade 131-135. Each of the drill blades 131-135 have an arc such as the arc 141 at the edge of the blade 131, wherein the arc 141 can have a drill blade normal vector at any position on the surface of the arc 141. For example, the drill blade normal vector 117 is at the axial and radial position represented by the point 119, wherein the point 119 shares an axial and radial position with a portion of a shaped cutter 110 and has a different azimuthal position from the shaped cutter 110. The bit cutters can include rounded cutters such as a rounded cutter 120 or shaped cutters such as the shaped cutter 110. Each of the rounded cutters can have a circular cutter surface. For example, the rounded cutter 120 can have a circular cutter surface 122.

Each of the shaped cutters can have a shaped cutter surface, wherein the shaped cutter surface has a partially flattened boundary exposed to outside of the drill bit 100. For example, the shaped cutter 110 includes an engagement surface 112 comprising a PDC material that has an exposed partially flattened boundary 114, wherein the exposed partially flattened boundary 114 can be flat or semi-curved, and wherein a semi-curved exposed partially flattened boundary has a curvature that is less than an equivalent curvature of a circle having a radius equal to the maximum radius of the engagement surface 112. As an additional example, with reference to FIG. 6 further described below, a shaped cutter engagement surface 641 can have an exposed partially flattened boundary 648. A shaped cutter centerline 116 is perpendicular to the exposed partially flattened boundary 114. In some embodiments, a cutter reference vector for the shaped cutter 110 can be the drill blade normal vector 117, and a tilt of a tilted shaped cutter is the angular difference between the drill blade normal vector 117 and the shaped cutter centerline 116. In some embodiments, the drill blade normal vector 117 can be a vector that at an axial position and radial position within an axial distance threshold and radial distance threshold from the tilted shaped cutter. In some embodiments, the distance thresholds can both be equal to zero. Alternatively, one distance threshold can be zero and the other can be equal to a non-zero value. For example, a drill blade normal vector can have an axial distance threshold equal to zero while the radial distance threshold is nonzero, which can result in the drill blade normal vector having a same axial position as the tilted shaped cutter but not a same radial drill blade normal vector.

Alternatively, instead of a cutter reference vector based on the drill blade, the system can use a profile tilt vector. In some embodiments, a profile tilt vector is directed from a point on the shaped cutter to a contact point on the tilted shaped cutter during a drilling operation, wherein the contact point of a shaped cutter is a point on the boundary of the shaped cutter that is the first point to come into contact with a material being drilled during a drilling operation. Alternatively, the contact point can be determined based on an area of engagement, wherein the contact point is at a boundary of the area of engagement, and wherein the area of engagement is the area on the engagement surface that engages with the material being drilled during a drilling operation. For example, a profile tilt vector can be a vector directed from the center of the engagement surface 112 and a bit profile 132, wherein the bit profile 132 is a succession of lines and/or arcs that represents a portion of a surface connecting the contact points on each bit cutter during a drilling operation. As an additional example, the bit profile 132 can be similar to the bit profile 340 shown in FIG. 3, further described below. In some embodiments, bit profiles can be categorized based on the length and angles of their corresponding lines and arcs, wherein a flat bit profile, a short bit profile or a long bit profile can be defined based on the length. Furthermore, a furthest point on the bit profile measured along the bit rotational axis can define the nose of the corresponding bit. As described below in flowcharts 1100 and 1100, the bit profile 132 and its corresponding profile tilt vectors can be determined based on previous results stored in a data structure, experimental results, a mechanical simulation, and/or a surface minimization method. In some embodiments, bit cutters can be defined by a diameter and a position with respect to a bit profile.

Figure 2:
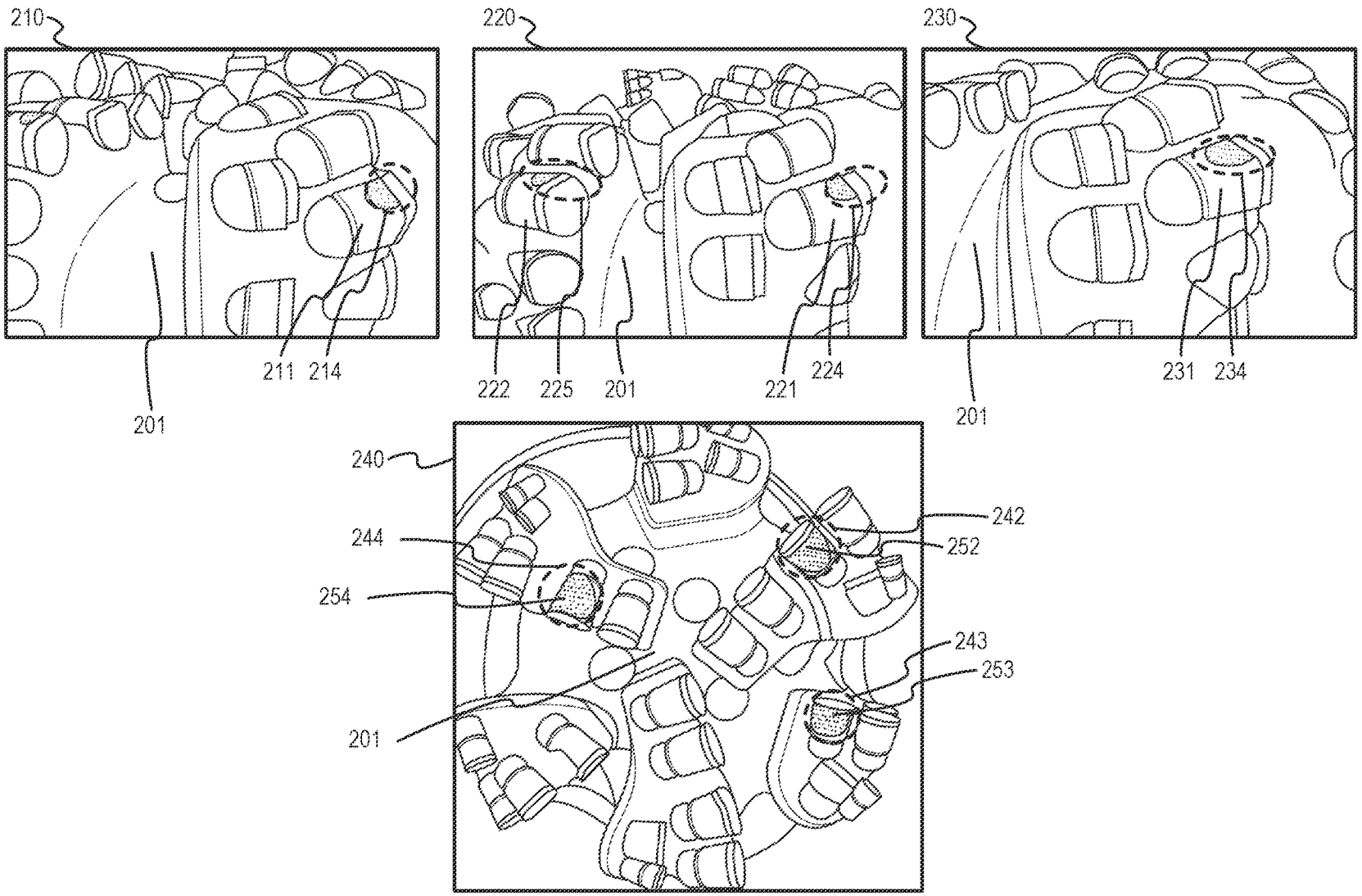
FIG. 2 PRIOR ART
FIG. 2 depicts sets of shaped cutters showing degradation after a drilling operation.

FIG. 2 depicts sets of shaped cutters showing degradation after a drilling operation. The boxed regions 210, 220, 230, and 240 each depict a portion of a drill bit 201 having one or more degraded shaped cutters in the form cutter dulling. For example, the boxed region 210 shows a first view of the drill bit 201, wherein a dashed circle 214 show a dulled region on the bit cutter 211. Similarly, the boxed region 220 includes a dashed circle 224 and a dashed circle 225, wherein the dashed circle 224 shows a dulled region on the bit cutter 221, and the dashed circle 225 show a dulled region on the bit cutter 222. In addition, the boxed region 230 depicts a dashed circle 234 showing a dulled region on the bit cutter 231. The boxed region 240 depicts a top view of the drill bit 201 as a whole, wherein each of the dashed circles 242-244 show a different dulled region on the bottom-facing shaped cutters 252-254 of the drill bit 201. By using tilted shaped cutters as described below, the cutter degradation shown in FIG. 2 can be reduced during a drilling operation.

Example Bit Cutters

Figure 3:
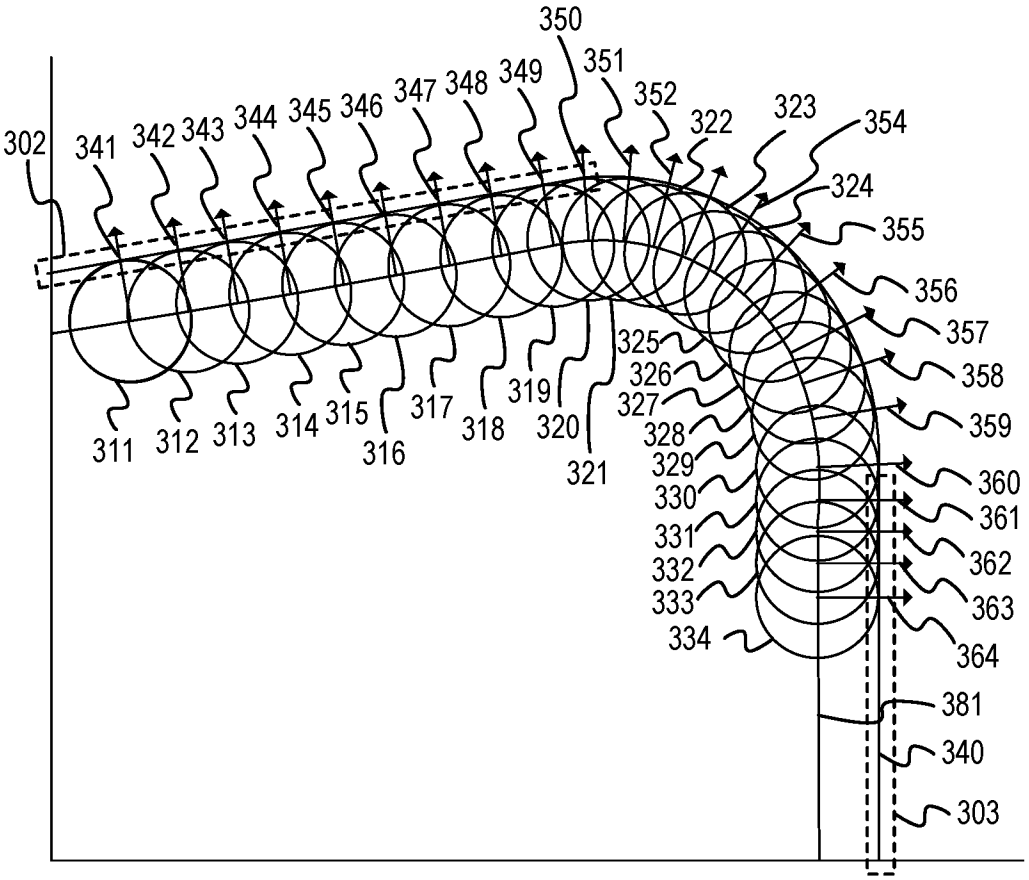
FIG. 3 is a side view of possible round cutter positions along a drill blade.

FIG. 3 is a side view of possible round cutter positions along a drill blade. FIG. 3 includes a set of overlapping bit cutter locations across a set of drill blades overlaid on top of each other, wherein each drill blade has a drill blade profile 381. Each of the circles 311-334 represent a set of possible round cutter positions along a drill blade. Each of the cutter centerlines 341-364 correspond with one of the circles 311-334, wherein the cutter centerline of a round cutter can point from a center of the round cutter's cutting surface to a bit profile 340 and is normal to the bit profile 340, wherein the bit profile 340 can be generated using experimental results, a simulation or a surface minimization method. As shown by the alignment between circles 311-320 and the straight segments of the bit profile 340 as shown in a boxed region 302 and a boxed region 303, a plurality of the cutter centerlines 341-350 of the drill cutters can be parallel with respect to each other.

Figure 4:
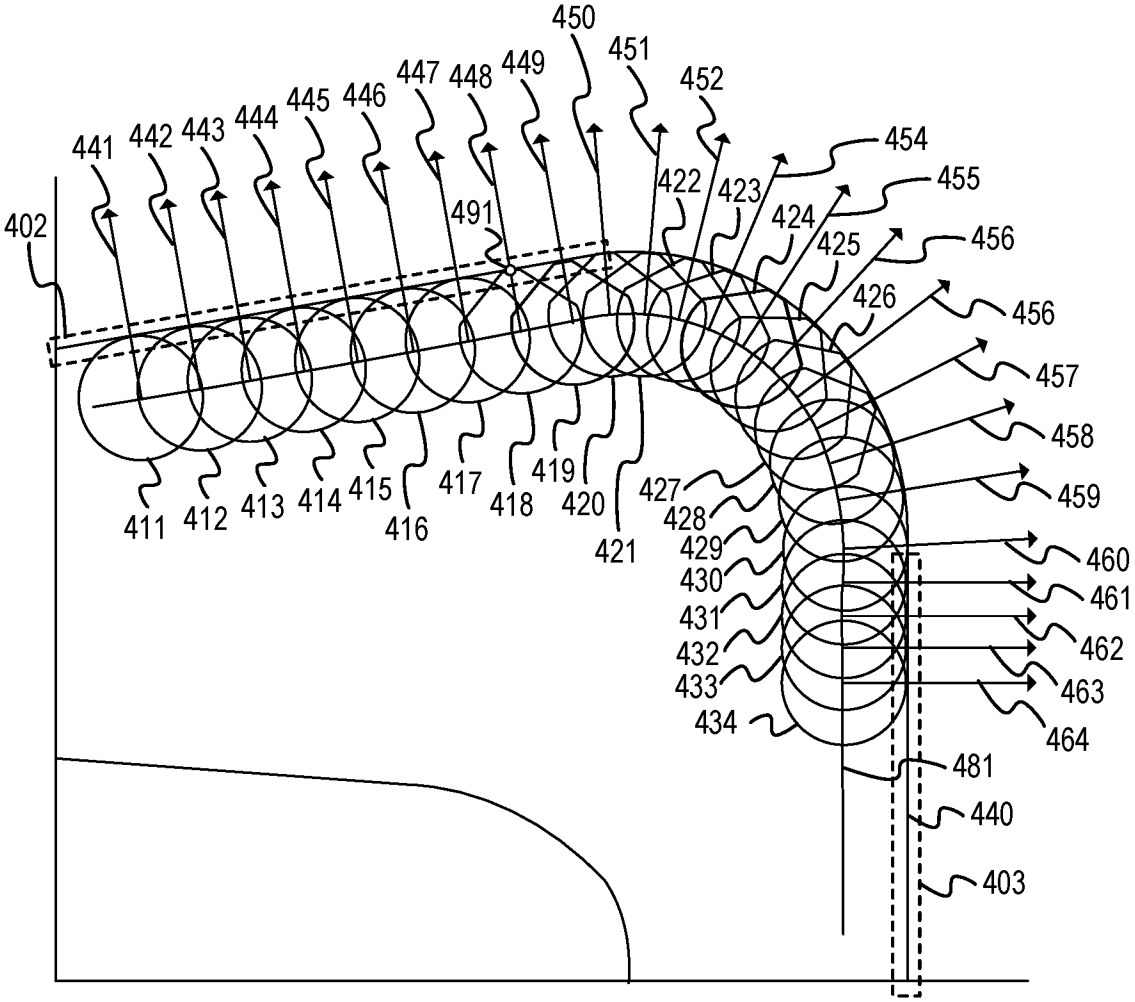
FIG. 4 is a side view of overlapping, possible round cutter positions and possible shaped cutter positions along a drill blade.

FIG. 4 is a side view of overlapping, possible round cutter positions and possible shaped cutter positions along a drill blade. Each of the circles 411-417 and 427-434 represent a set of possible round cutter positions along a drill blade of a drill bit, wherein each drill blade has a drill blade profile 481. Each of the shaped cutter shapes 418-426 represent a set of possible shaped cutter positions and their corresponding orientations along a drill blade of the same drill bit, wherein each of the drill blades also has a drill blade profile 481. Each of a set of cutter centerlines 441-464 represent a cutter centerline for one of the cutters corresponding with the circles and shaped cutter shapes 411-434. The bit profile 440 represents a boundary that includes the contact points of the set of cutters at each of the possible cutter positions corresponding with the circles and shaped cutter shapes 411-434. As shown, the contact points such as the contact point 491 are non-tilted contact points. A non-tilted contact point on a non-tilted shaped cutter is at an intersection of the cutter centerline and the tangent to a bit profile of the drill bit, wherein the cutter centerline is perpendicular to the tangent. Furthermore, as shown by a plurality of the cutter centerlines 448-450, a plurality of cutter centerlines corresponding with shaped cutters along the bit profile 440 can be parallel with each other, which can reduce the stress experienced by the cutters at the positions corresponding with the circles and shaped cutter shapes 411-420.

Figure 5:
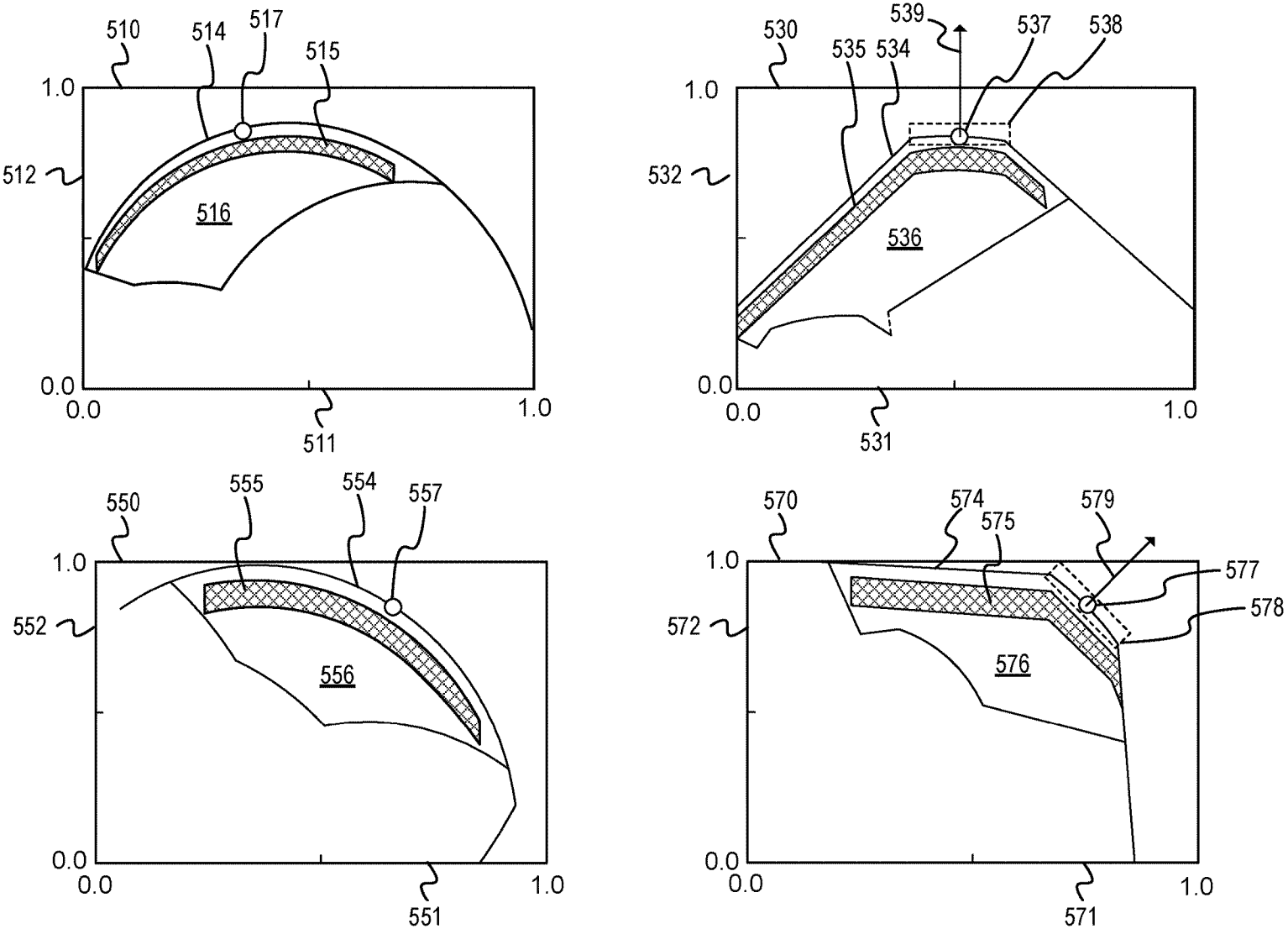
FIG. 5 is a set of side view simulation results of bit cutters at different locations along a drill blade, and their corresponding areas of engagement during a drilling operation.

FIG. 5 is a set of side view simulation results of bit cutters at different locations along a drill blade, and their corresponding areas of engagement during a drilling operation. FIG. 5 includes a box 510 that includes a round cutter profile 514. Simulation results based on the round cutter profile 514 include a contact point 517, an area of engagement 516, and an area of elevated stress 515. The box 510 includes a horizontal axis 511 representing a unitless width and a vertical axis 512 representing a unitless height. The simulation results can include a prediction that determines the shapes of the area of engagement 516 and the area of elevated stress 515 within it, wherein the area of elevated stress 515 has boundary that is geometrically similar to an edge of the round cutter profile 514. In addition, the simulation results can include a prediction about the position of the contact point 517 based on a simulated drilling speed, wherein the contact point 517 is at an edge of the area of engagement 516. In some embodiments, reducing the simulated drilling speed can reduce the size of the area of engagement 516, wherein a minimal simulated drilling speed can reduce the area of engagement 516 to the contact point 517. With reference to FIG. 3, the round cutter profile 514 can represent a round cutter experiencing stress during a drilling operation at a shoulder position of the drill bit such as a cutter at a cone position corresponding with the bottom-facing position of the circle 334.

FIG. 5 also includes a box 550 that includes a round cutter profile 554. Simulation results based on the round cutter profile 554 include a contact point 557, an area of engagement 556, and an area of elevated stress 555. The box 550 includes a horizontal axis 551 representing a unitless width and a vertical axis 552 representing a unitless height. The simulation results can generate a prediction that determines the shapes of the area of engagement 556 and the area of elevated stress 555 within it. In addition, the simulation results can predict the location of the contact point 557 based on a simulated drilling speed. For example, a simulation with a reduced drilling speed can correspond with a reduced area of engagement, wherein simulating at a minimum drilling speed for a cutter can result in the determination of the contact point by minimizing the area of engagement to the contact point for the cutter. With reference to FIG. 3, the round cutter profile 554 can represent a round cutter experiencing stress during a drilling operation at a shoulder position of the drill bit such as a cutter at a cone position corresponding with the shoulder position of the circle 323.

FIG. 5 also includes a box 530 that includes a shaped cutter profile 534. The shaped cutter profile 534 has an exposed partially flattened boundary 538 having a shaped cutter centerline 539 at an angle of approximately 90 degrees relative to a plane perpendicular to the drill bit axis. Simulation results based on the shaped cutter profile 534 include a contact point 537, an area of engagement 536, and an area of elevated stress 535. The box 530 includes a horizontal axis 531 representing a unitless width and a vertical axis 532 representing a unitless height. The simulation results can include a prediction that determines the shapes of the area of engagement 536 and the area of elevated stress 535 within it, wherein the area of elevated stress 535 has a boundary that is geometrically similar to the edge of the shaped cutter profile 534. In addition, the simulation results can include a prediction about the position of the contact point 537 based on a simulated drilling speed, wherein the contact point 537 is at an edge of the area of engagement 536. In some embodiments, reducing the simulated drilling speed can reduce the size of the area of engagement 536, wherein a minimal simulated drilling speed can reduce the area of engagement 536 to the contact point 537. With reference to FIG. 3, the shaped cutter profile 534 can represent a shaped cutter experiencing stress during a drilling operation at a shoulder position of the drill bit such as a cutter at a cone position corresponding with the bottom-facing position of the circle 334.

FIG. 5 also includes a box 570 that includes a shaped cutter profile 574. In contrast to the exposed partially flattened boundary 538 and its cutter centerline 539 shown in box 530, the shaped cutter profile 574 has an exposed partially flattened boundary 578 having a shaped cutter centerline 579 at an angle of approximately 45 degrees relative to a plane perpendicular to the drill bit axis. Simulation results based on the shaped cutter profile 574 include a contact point 577, an area of engagement 576, and an area of elevated stress 575. The box 570 includes a horizontal axis 571 representing a unitless width and a vertical axis 572 representing a unitless height. The simulation results can include a prediction that determines the shapes of the area of engagement 576 and the area of elevated stress 575 within it, wherein the area of elevated stress 575 has a boundary that is geometrically similar to the edge of the shaped cutter profile 574. In addition, the simulation results can include a prediction about the position of the contact point 577 based on a simulated drilling speed, wherein the contact point 577 is at an edge of the area of engagement 576 and approximately in the center of the exposed partially flattened boundary 578. In some embodiments, reducing the simulated drilling speed can reduce the size of the area of engagement 576, wherein a minimal simulated drilling speed can reduce the area of engagement 576 to the contact point 577. With reference to FIG. 3, the shaped cutter profile 574 can represent a shaped cutter experiencing stress during a drilling operation at a shoulder position of the drill bit such as a cutter at a cone position corresponding with the shoulder position of the circle 323.

Example Tilted Bit Cutters

Figure 6:
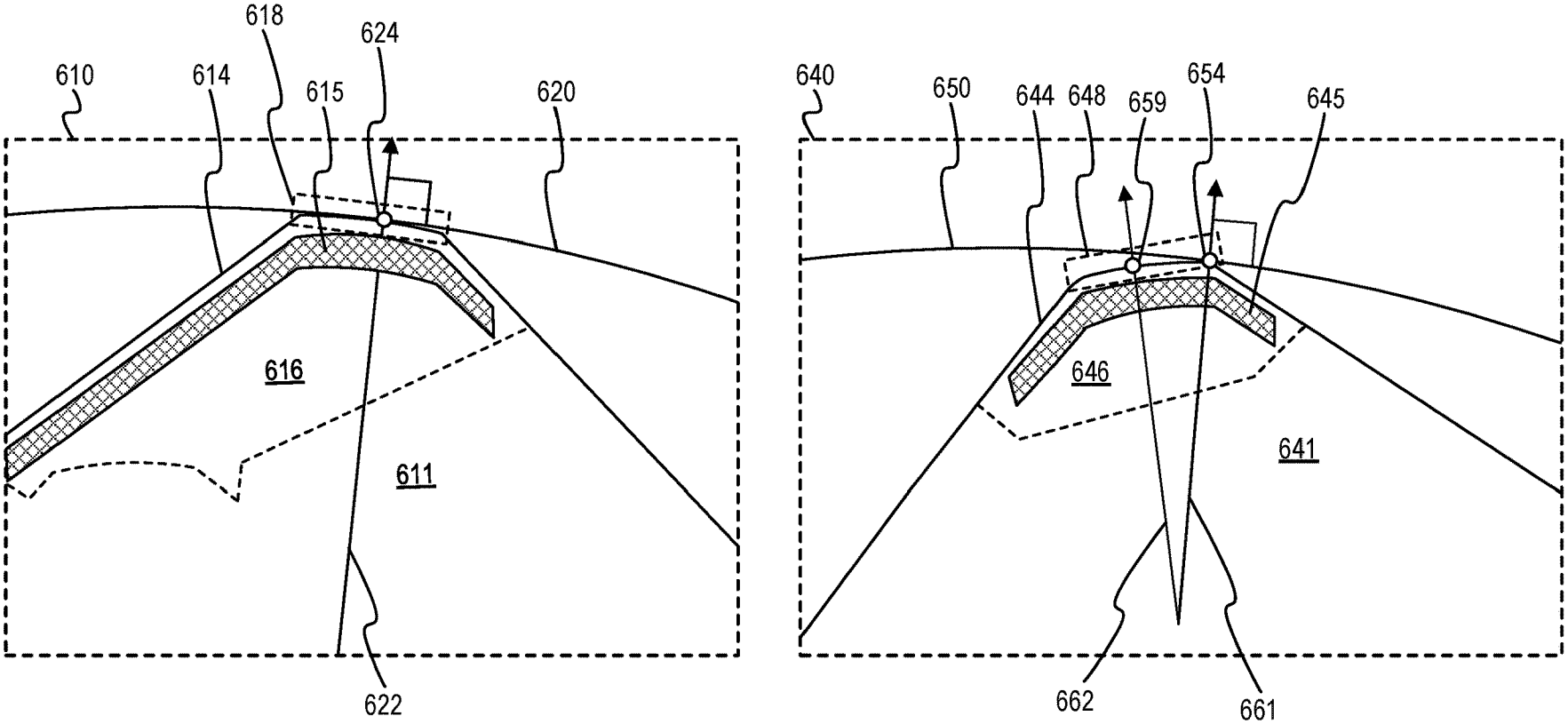
FIG. 6 is a side view of a non-tilted shaped cutter and a tilted shaped cutter.

FIG. 6 is a side view of a non-tilted shaped cutter and a tilted shaped cutter. A dashed box 610 depicts a shaped cutter engagement surface 611 having the shaped cutter profile 614. The shaped cutter profile 614 includes a shaped cutter centerline 622 that is co-planar with the shaped cutter profile 614 and is perpendicular to the exposed partially flattened boundary 618. The shaped cutter centerline 622 is co-linear with a cutter reference vector of the shaped cutter profile 614. The cutter reference vector can be a drill blade normal vector that is normal to a position on a drill blade surface, wherein the position includes a same radial position and/or a same axial position as a portion of the shaped cutter engagement surface 611.

In some embodiments, the system can determine a profile tilt vector that is directed from at least one of a center and an edge of the shaped cutter profile 614 to a contact point 624, wherein the contact point 624 is at the same point as the center of the partially flattened boundary 618 and is included in a bit profile 620. The contact point 624 is shown to be on-center with respect to the center of the exposed partially flattened boundary 618, wherein the contact point 624 is at the center of the partially flattened boundary 618. As described below for the flowcharts 1000 and 1100 of FIGS. 10-11, the bit profile 620 can be determined based on previous results stored in a data structure, experimental results, a mechanical simulation, and/or a surface minimization method. For example, the bit profile 620 can be determined using a mechanical simulation.

During a drilling operation, the shaped cutter engagement surface 611 can be in contact with a borehole wall at the contact point 624. The shaped cutter engagement surface 611 can experience stress along a significant portion of the area of engagement 616, wherein the stress can be elevated over the elevated stress zone 615. This stress can damage and/or degrade the shaped cutter engagement surface 611, wherein the damage/degradation can be reduced by tilting the shaped cutter engagement surface 611 with respect to the cutter reference vector.

FIG. 6 also includes a dashed box 640 that depicts a bit profile 650 connected with a shaped cutter engagement surface 641 having the shaped cutter profile 644. The shaped cutter profile 644 includes cutter centerline 652 that is co-planar with the shaped cutter profile 644 and perpendicular to the exposed partially flattened boundary 648 having an exposed partially flattened boundary center 659. The cutter centerline 652 is non-parallel with a cutter reference vector 661 of the shaped cutter profile 644. The cutter reference vector 661 can be a drill blade normal vector that is normal to a position on a drill blade surface, wherein the position includes a same radial position and/or a same axial position as a portion of the shaped cutter having the shaped cutter engagement surface 641.

In some embodiments, the system can determine a profile tilt vector that is directed from at least one of a center and an edge of the shaped cutter profile 644 to a contact point 654, wherein the contact point 624 is included in a bit profile 640. The contact point 654 is off-centered with respect to the exposed partially flattened boundary center 659, wherein being off-centered means that the contact point 654 is a non-zero distance away from the exposed partially flattened boundary center 659. Described below in flowcharts 1000 and 1100, the bit profile 640 can be determined based on previous results stored in a data structure, experimental results, a mechanical simulation, and/or a surface minimization method. For example, the bit profile 640 can be determined using a mechanical simulation.

During a drilling operation, the shaped cutter engagement surface 641 is in contact with a borehole wall at the contact point 654. In contrast with the area of engagement 646, an exposed partially flattened boundary 648 experiences less stress over the body of the shaped cutter, when compared to the example shown in box 610. The elevated stress zone 645 is instead concentrated near the contact point 654, resulting in a smaller area of engagement 646 relative to the area of engagement 616 of box 610, and a smaller elevated stress zone 645 relative to the elevated stress zone 615 of box 610. Thus, in comparison to an un-tilted shaped cutter, the efficiency of the tilted shaped cutter engagement surface 641 is increased by focusing stress on a corner of the shaped cutter engagement surface 641 and away from a central flank of the tilted shaped cutter engagement surface 641.

Figure 7:
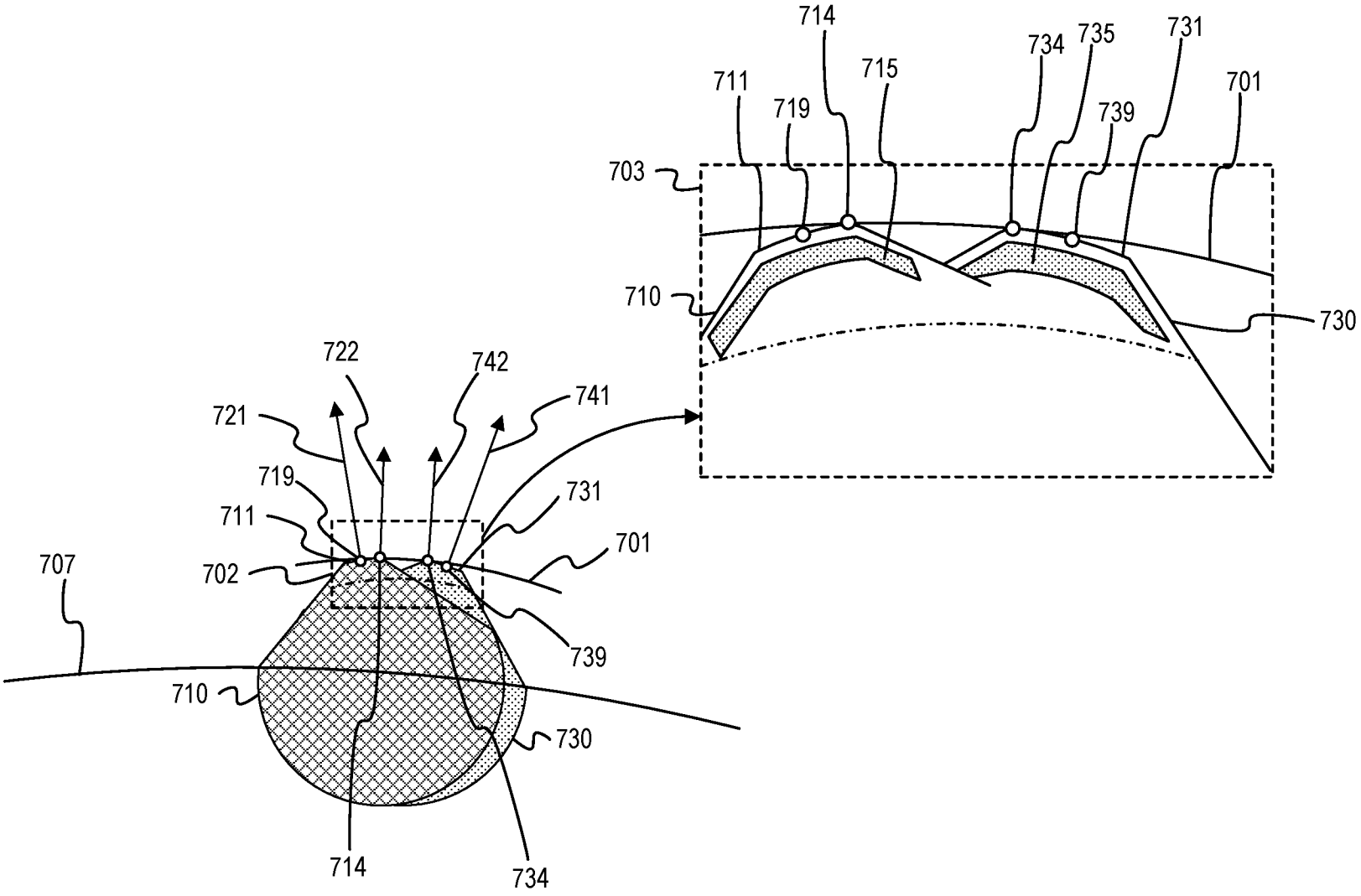
FIG. 7 is a side view of tilted bit cutters arranged in a saw teeth cross cut arrangement.

FIG. 7 is a side view of tilted bit cutters arranged in a saw teeth cross cut arrangement. FIG. 7 includes a drill blade surface 707 having a leading cutter reference vector 722 corresponding to a first axial position and a trailing reference vector 742 corresponding to a second axial position. The drill blade surface 707 includes a leading tilted shaped cutter 710 and a trailing tilted shaped cutter 730 in a saw teeth cross cut arrangement. The leading tilted shaped cutter 710 is ahead of the trailing tilted shaped cutter 730 with respect to the rotation direction of the drill bit. For example, if the drill bit is rotating in a counter-clockwise direction from 0 degrees to 360 degrees, the leading drill bit can have an azimuthal position of 0 degrees and the trailing drill bit can have an azimuthal position of 355 degrees.

The leading tilted shaped cutter 710 has a leading exposed partially flattened boundary 711 with a leading exposed partially flattened boundary center 719. The leading tilted shaped cutter 710 can include a leading cutter centerline 721 that passes through the leading exposed partially flattened boundary center 719 and is tilted with respect to the leading cutter reference vector 722. The leading tilted shaped cutter 710 also has a leading contact point 714, wherein the leading tilted shaped cutter 710 is in contact with a bit profile 701 at the leading contact point 714. As shown in FIG. 7, the leading contact point 714 is off-centered with respect to the leading exposed partially flattened boundary center 719.

The trailing tilted shaped cutter 730 has a trailing exposed partially flattened boundary 731 with a trailing exposed partially flattened boundary center 739. The trailing shaped cutter 730 can include a trailing cutter centerline 741 that passed through the trailing exposed partially flattened boundary center 739 and is tilted with respect to the trailing cutter reference vector 742. The trailing tilted shaped cutter 730 also has a trailing contact point 734, wherein the trailing tilted shaped cutter 730 is in contact with the bit profile 701 at the trailing contact point 734. As shown in FIG. 7, the trailing contact point 734 is off-centered with respect to the trailing exposed partially flattened boundary center 739.

The saw teeth cross cut arrangement is an alternating arrangement wherein the cutter centerlines of leading and trailing cutters are non-parallel with respect to each other and their respective reference vectors. For example, the leading cutter centerline 721 and the trailing cutter centerline 741 are non-parallel, the leading cutter centerline 721 is non-parallel with respect to the leading cutter reference vector 722, and the trailing cutter centerline 741 is non-parallel with respect to the trailing cutter reference vector 742. In such an arrangement, contact points of a leading tilted shaped cutter and a trailing tilted shaped cutter can be at opposite ends of their respective exposed partially flattened boundaries. For example, the leading contact point 714 is on the lower end of the leading exposed partially flattened boundary 711 with respect to the drill bit's axis of rotation (not shown), and the trailing contact point 734 is on the upper end of the leading exposed partially flattened boundary 731 with respect to the drill bit's axis of rotation. In other embodiments, a leading contact point can be on the right end of a leading exposed partially flattened boundary and the trailing contact point can be on the left end of the corresponding trailing exposed partially flattened boundary. Moreover, while leading shaped cutter and trailing shaped cutter are distinguished for illustrative purposes in this application, it should be apparent that any first shaped cutter sharing an axial position with a second shaped cutter along a drill bit can be set as a leading shaped cutter, wherein the second shaped cutter can be set as a trailing shaped cutter.

FIG. 7 also includes an expanded view of the boxed outline 702 within the boxed outline 703. The boxed outline 703 includes the leading tilted shaped cutter 710 and the trailing tilted shaped cutter 730. In addition, the boxed outline 703 includes an elevated stress region 715 and the leading contact point 714 as determined from a simulation of a drilling operation using the leading tilted shaped cutter 710. Furthermore, the boxed outline 703 includes the elevated stress region 735 and the trailing contact point 734 as determined from a simulation of a drilling operation using the trailing tilted shaped cutter 730. As shown by the elevated stress regions 715 and 735, the saw teeth cross cut arrangement can distribute the elevated stress regions 715, 735 experienced by different tilted shaped cutters 710, 730, increasing the effective lifespan of each tilted shaped cutter 710, 730.

Figure 8:
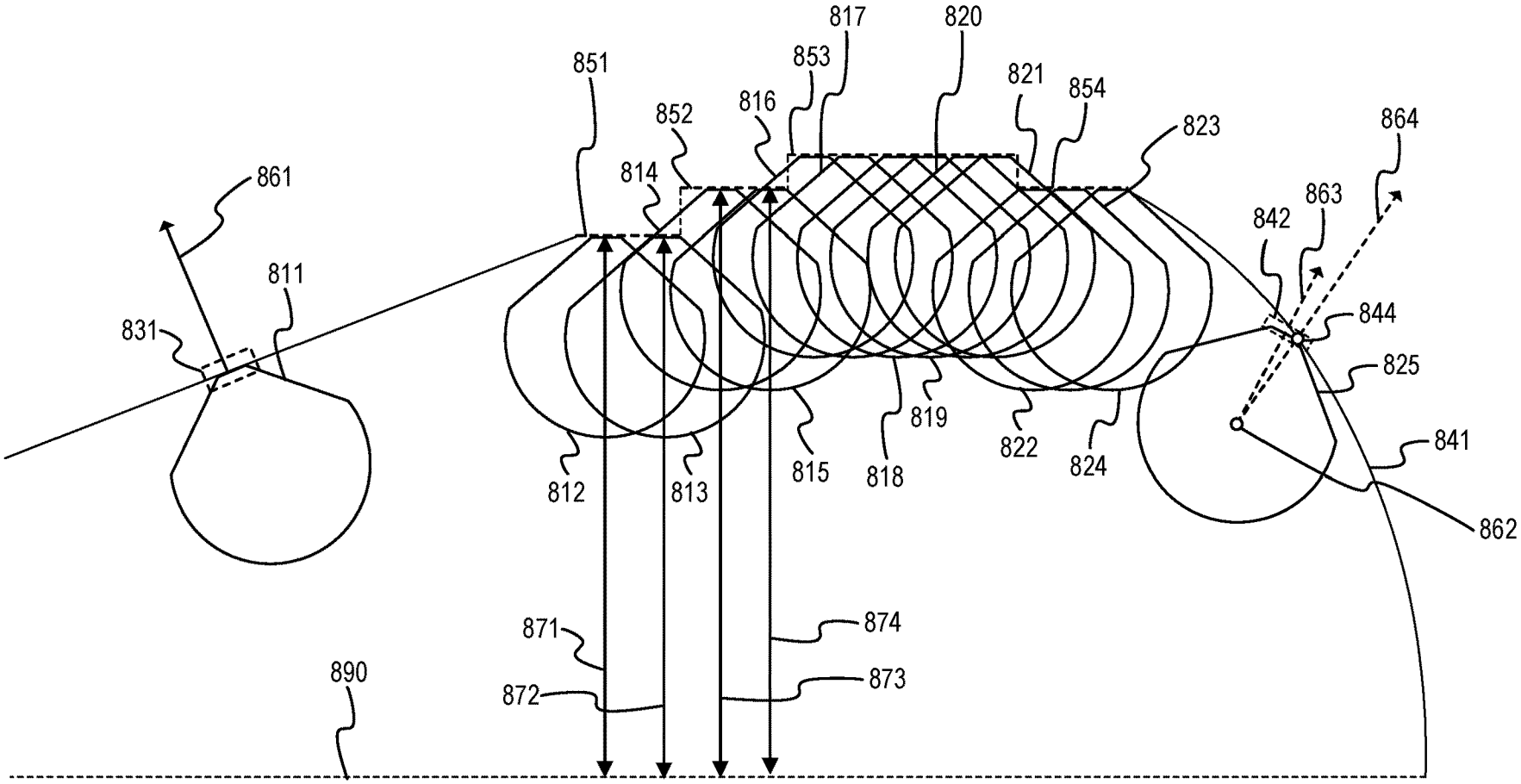
FIG. 8 is a side view of a set of possible shaped cutter positions in a step profile arrangement.

FIG. 8 is a side view of a set of possible shaped cutter positions in a step profile arrangement. FIG. 8 includes a set of shaped cutters shapes 811-825, wherein each of the shaped cutter shapes represent a shaped cutter position and orientation along one or more blades of a drill bit. In some embodiments, the shapes of the shaped cutters shapes 811-825 can define a bit profile 841, wherein the bit profile 841 can be determined based on recorded cutter data, a simulation result, and/or a surface minimization method. With reference to FIG. 4, in contrast to the bit profile 440, the bit profile 841 includes a set of radial steps represented by dashed lines 851-854, wherein each of the dashed lines represent a portion of the bit profile that is substantially parallel with a drill bit axis 890.

In some embodiments a set of shaped cutters can define a stepped profile arrangement, wherein the set of shaped cutters can have subsets of same-step shaped cutters in the step profile arrangement. For each subset of same-step shaped cutters, each same-step shaped cutter in the subset can have the same maximum distance from the drill bit axis 890. For example, a first maximum distance represented by line 871 can be equal to the second maximum distance represented a line 872, wherein the first maximum distance is the maximum distance between a first shaped cutter at a position/orientation represented by the shaped cutter shape 812 and the drill bit axis 890, and wherein the second maximum distance is the maximum distance between a second shaped cutter at a position/orientation represented by the shaped cutter shape 813 and the drill bit axis 890. The shaped cutters at the positions represented by the shaped cutter shapes 812-813 can be part of a first subset of same-step shaped cutters. Furthermore, the radial distance represented by the lines 871-872 can correspond with a first step represented by the dashed line 851, wherein the first step corresponds with the first subset of same-step shaped cutters.

Similarly, a third maximum distance represented by line 873 can be equal to the fourth maximum distance represented a line 874, wherein the third maximum distance is the maximum distance between a third shaped cutter at a position/orientation represented by the shaped cutter shape 814 and the drill bit axis 890, and wherein the fourth maximum distance is the maximum distance between a fourth shaped cutter at a position/orientation represented by the shaped cutter shape 815 and the drill bit axis 890. The shaped cutters at the positions represented by the shaped cutter shapes 814-815 can be part of a second subset of same-step shaped cutters. Furthermore, the radial distance represented by the lines 873-874 can correspond with a second step represented by the dashed line 852, wherein the second step corresponds with the second subset of same-step shaped cutters.

FIG. 8 also includes the dashed line 853 representing a third step that corresponds with the third subset of same-step shaped cutters and the dashed line 854 representing a fourth step that corresponds with the fourth subset of same-step shaped cutters. The third subset of same-step shaped cutters can include the shaped cutters 816-821, and the fourth subset of same-step shaped cutters can include the shaped cutters 822-824. In some embodiments, the distances from the drill bit axis 890 corresponding with each of the steps represented by the dashed lines 851, 852, 853, and 854 can be different from each other. Alternatively, two or more of the distances from the drill bit axis 890 corresponding with each of these steps can be equal to each other.

In addition, a shaped cutter can be at the position and orientation represented by the shaped cutter shape 811 and can have a cutter centerline 861 that is normal to the exposed partially flattened boundary 831. Furthermore, a tilted shaped cutter can be at the position and orientation represented by the shaped cutter shape 825 and can be tilted with respect to the cutter reference vector 864. The tilted shaped cutter profile 825 has a cutter centerline 863 that points from a cutter center 862 to the center of an exposed partially flattened boundary 842, wherein the cutter centerline 861 is at an angle with respect to the cutter reference vector 864. In some embodiments, the cutter reference vector 864 can be determined to be a vector directed from the cutter center 862 to the contact point 844. In some embodiments, a cutter center can be a geometric center of an engagement surface.

Alternatively, a cutter center can be at a center of rotation with respect to a circular arc of the engagement surface.

Figure 9:
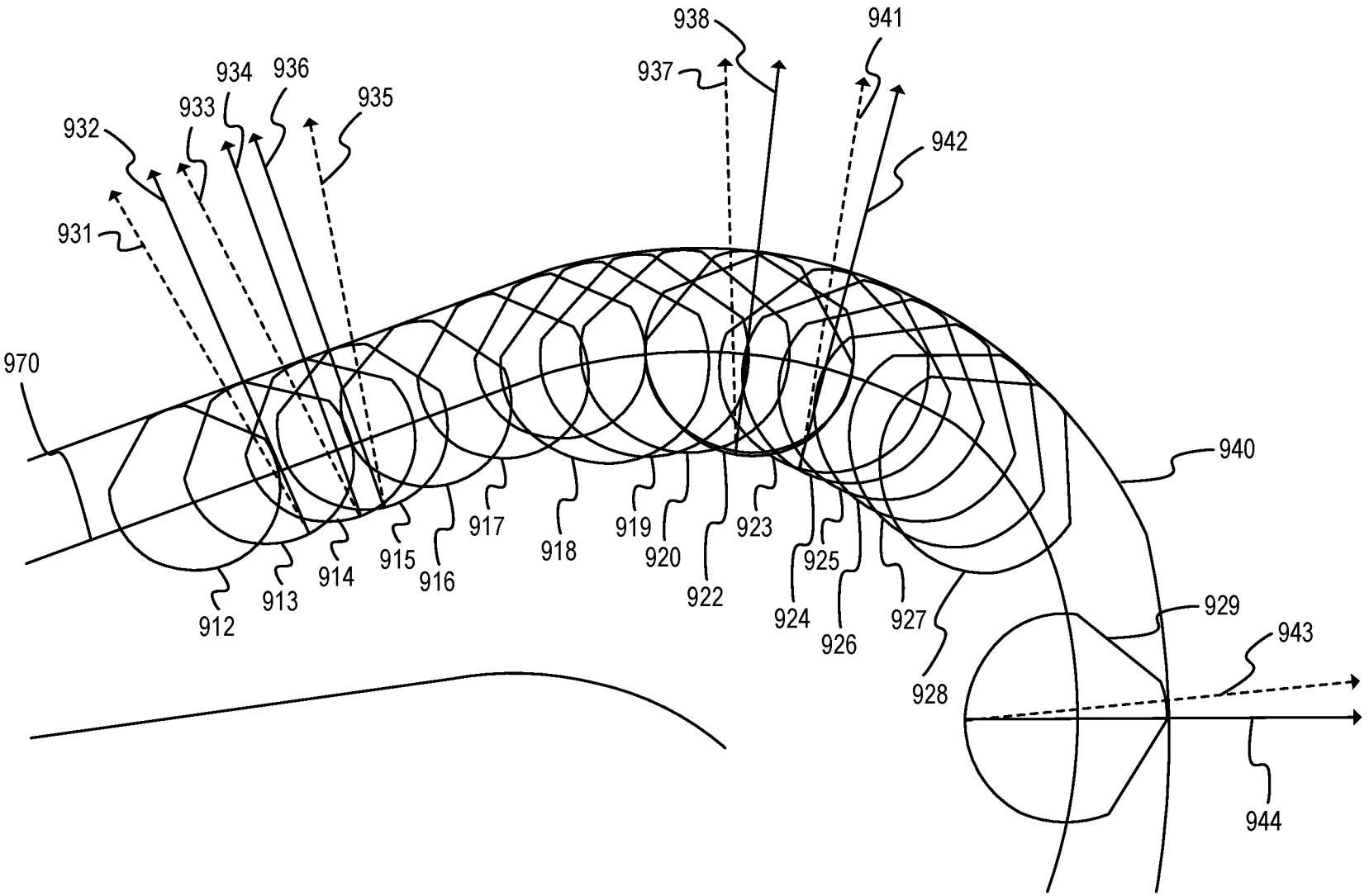
FIG. 9 is a side view of a set of possible shaped cutter positions including tilted shaped cutter positions.

FIG. 9 is a side view of a set of possible shaped cutter positions including tilted shaped cutter positions. FIG. 9 includes a set of shaped cutters shapes 912-929, wherein each of the shaped cutter shapes represent a shaped cutter position and orientation along one or more blades of a drill bit having a drill blade profile 970. In some embodiments, the shapes of the shaped cutters shapes 911-925 can define a bit profile 940, wherein the bit profile 940 can be determined based on recorded cutter data, a simulation result, and/or a surface minimization method. As shown in FIG. 9, an uphole direction is the left direction and a downhole direction is the right direction. FIG. 9 also includes a set of cutter reference vectors 932, 934, 936, 938, 942 and 944, wherein each of the cutter reference vectors can be parallel to a respective drill blade normal vector that is normal to a point on the drill blade profile 970 that includes a same axial position and/or same radial position as a portion of their respective tilted shaped cutter.

The shaped cutter shapes 913-915, 922-923 and 929 can represent tilted cutter orientations. The shaped cutter shape 913 can represent a first side cutter position and a tilted cutter orientation wherein a shaped cutter centerline 931 is tilted with respect to a shaped cutter reference vector 932 at an angle greater than or equal to 5 degrees in the uphole direction. The shaped cutter shape 914 can represent a second side cutter position and a tilted cutter orientation wherein a shaped cutter centerline 933 is tilted with respect to a shaped cutter reference vector 934 at an angle greater than 9 degrees in the uphole direction. The shaped cutter shape 915 can represent a third side cutter position and a tilted cutter orientation wherein a shaped cutter centerline 935 is tilted with respect to a shaped cutter reference vector 936 at an angle greater than or equal to 5 degrees in the downhole direction. The shaped cutter shape 922 can represent a first shoulder cutter position and a tilted cutter orientation wherein a shaped cutter centerline 937 is tilted with respect to a shaped cutter reference vector 938 at an angle greater than or equal to 5 degrees in the uphole direction. The shaped cutter shape 923 can represent a second shoulder cutter position and a tilted cutter orientation wherein a shaped cutter centerline 941 is tilted with respect to a shaped cutter reference vector 942 at an angle greater than or equal to 5 degrees in the uphole direction. The shaped cutter shape 929 can represent a bottom position of the drill bit and a tilted cutter orientation wherein a shaped cutter centerline 943 is tilted with respect to a shaped cutter reference vector 944 at an angle greater than or equal to 5 degrees in the uphole direction, and wherein the shaped cutter reference vector 944 is parallel with the axis of rotation of the drill bit.

Figure 9A:
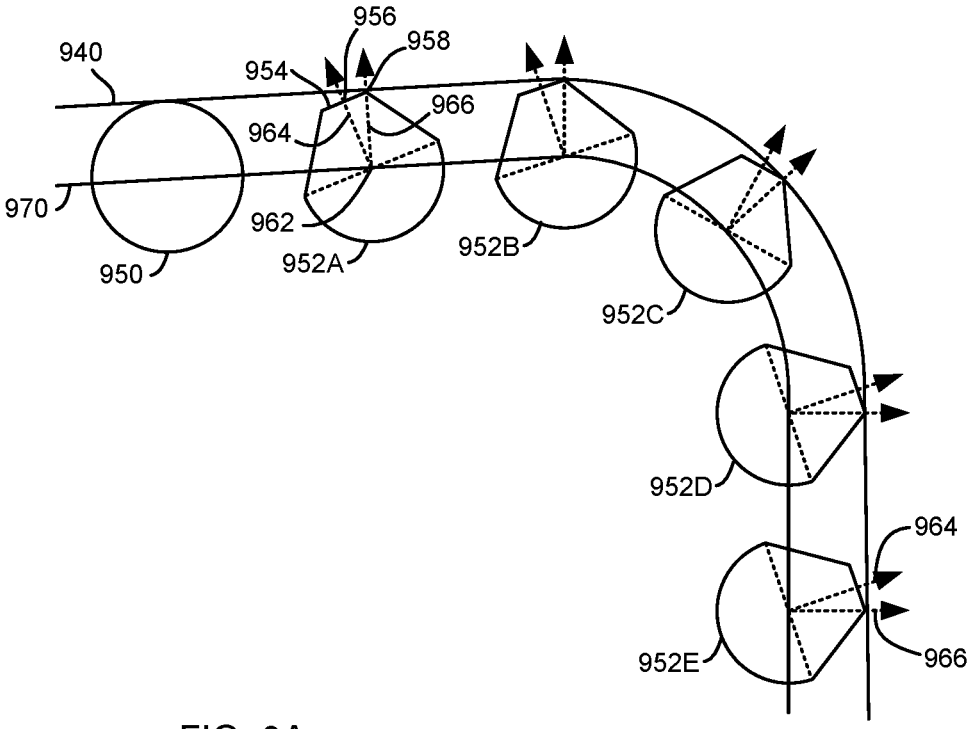
FIGS. 9A and 9B are side views of sets of cutters distributed along a drill blade.
Figure 9B:
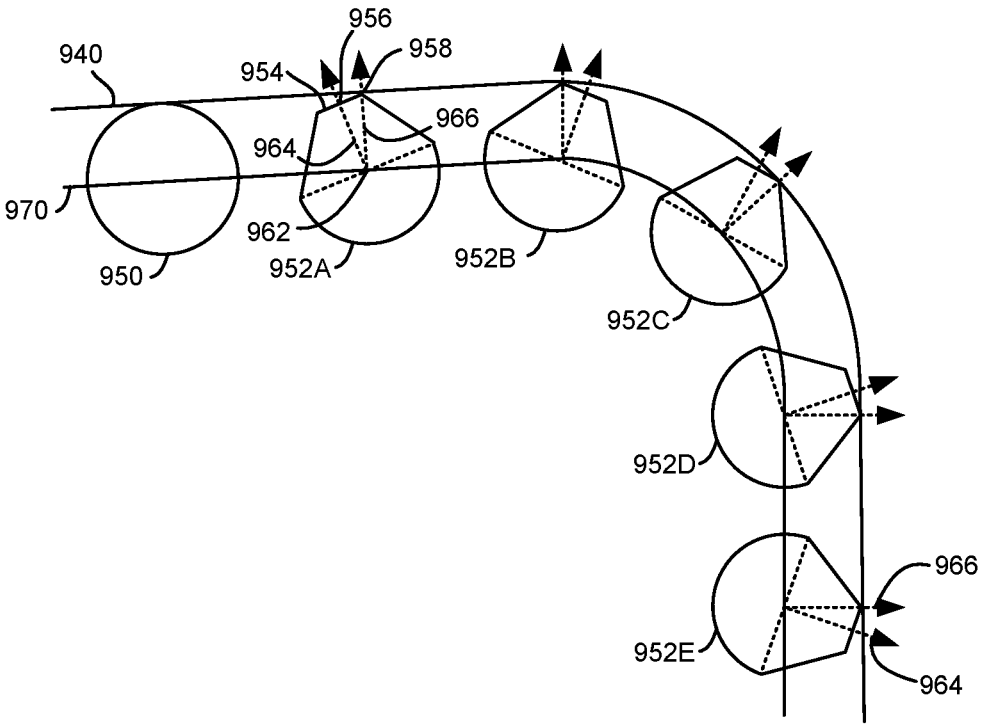

FIGS. 9A and 9B are side views of sets of cutters distributed along a drill blade, such as the drill blade 131 shown in FIG. 1. FIGS. 9A and 9B show combinations of circular and shaped cutters distributed roughly like the cutters of drill blade 131. As such they provide specific examples of how tilted shaped cutters may be placed and oriented in positions along drill blade 131.

In the example approach shown in FIGS. 9A and 9B, selected cutters of drill blade 131 (such as cutter 120) are replaced with tilted shaped cutters. In one such example, as shown in FIGS. 9A and 9B, the cutters of drill blade 131 are replaced with a circular cutter 950 and with five tilted shaped cutters 952A-E (collectively, "tilted shaped cutters 952").

In the examples shown in FIGS. 9A and 9B, each tilted shaped cutter 952 is secured to a location on a drill blade at a tilt angle. As illustrated with tilted shaped cutter 952, each tilted shaped cutter 952 includes a shaped cutter axis of rotation 962 and an engagement surface having an exposed partially flattened boundary 954. In the examples shown in FIGS. 9A and 9B, the exposed partially flattened boundary 954 includes a center point 956 and a separate contact point 958, where the contact point 958 is a point on the exposed partially flattened boundary 954 that is positioned to first encounter a material being drilled during a drilling operation.

In the example shown in FIGS. 9A and 9B, a shaped cutter centerline 964 is normal to the shaped cutter axis of rotation 962 and is perpendicular to and bisects the exposed partially flattened boundary 954 at the center point 956. A cutter reference vector 966 is normal to the shaped cutter axis of rotation 962, intersects the contact point 958, and intersects the shaped cutter centerline 964 at the shaped cutter axis of rotation 962. In some such example approaches, the cutter reference vector 966 intersects the drill bit profile 140 at the contact point 958. In some example approaches, the shaped cutter axis of rotation 962 intersects the drill blade profile 170.

In the example shown in FIG. 9A, each shaped cutter 952 has been rotated counterclockwise by a tilt angle defined by the angle between centerline 964 and cutter reference vector 966. In one such example approach, cutter reference vector 966 of tilted shaped cutter 952E is parallel to axis of rotation 101 of FIG. 1.

In the example shown in FIG. 9B, shaped cutters 952A, 952C and 952D have been rotated counterclockwise by a first tilt angle, while shaped cutters 952B and 952E have been rotated clockwise by a second tilt angle. In some such examples, the first and second tilt angles have the same magnitude. In one such example approach, cutter reference vector 966 of tilted shaped cutter 952E is parallel to axis of rotation 101 of FIG. 1.

Example Flowchart

The flowcharts described below are provided to aid in understanding the illustrations and are not to be used to limit scope of the claims. The flowcharts depict example operations that can vary within the scope of the claims. Additional operations may be performed; fewer operations may be performed; the operations shown may be performed in parallel; and the operations shown may be performed in a different order. For example, the operations depicted in blocks 1004-1008 of FIG. 10 can be performed in parallel or serially. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus, for execution.

Figure 10:
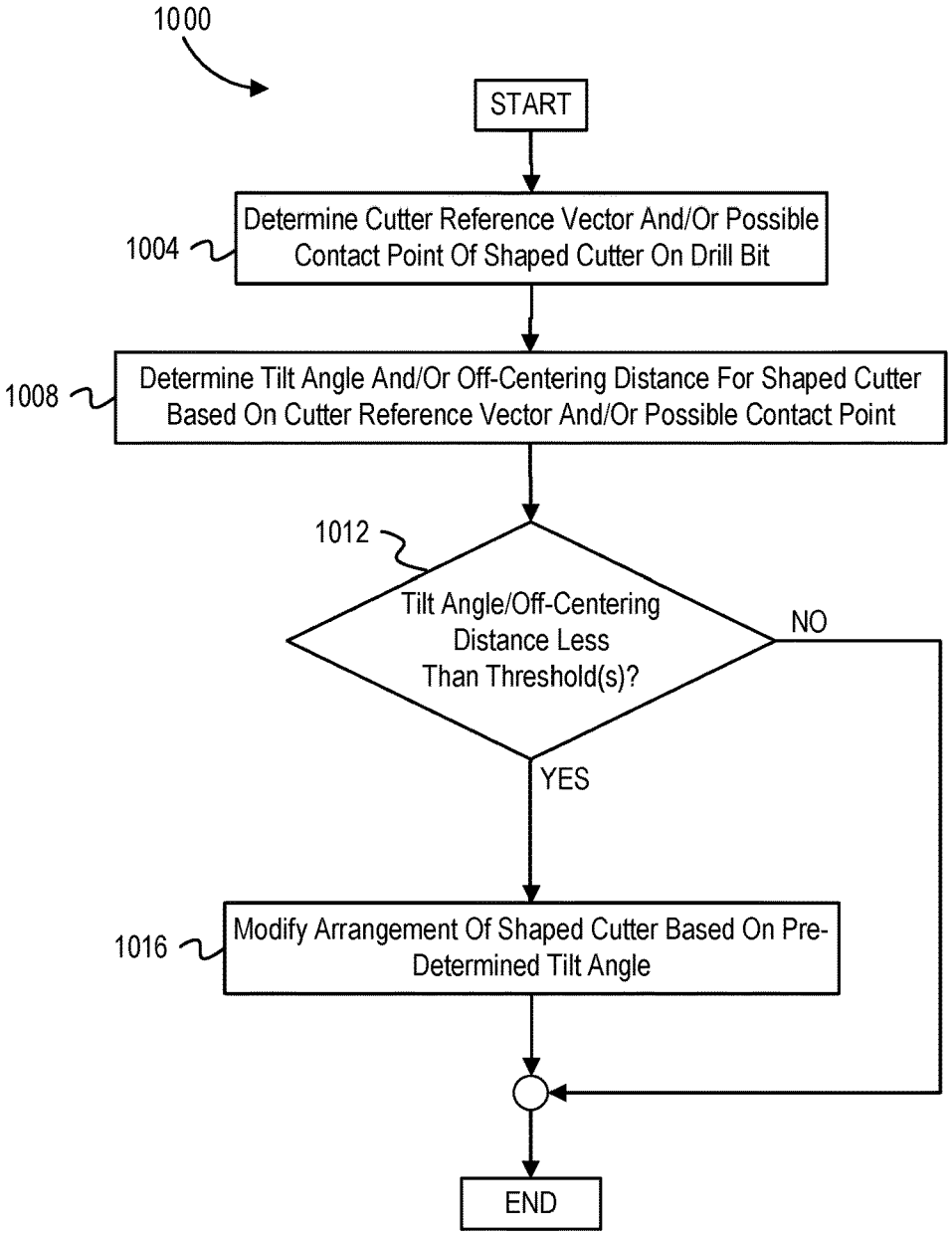
FIG. 10 is a flowchart of operations to modify a shaped cutter arrangement on a drill bit.

FIG. 10 is a flowchart of operations to modify a shaped cutter arrangement on a drill bit. FIG. 10 depicts a flowchart 1000 of operations to modify the shaped cutter arrangement of a drill bit using a system that includes a processor. For example, operations of the flowchart 1000 can be performed using a system similar to the computer system 1298 or computer device 1300 shown in FIGS. 12 and 13, respectively. Operations of the flowchart 1000 start at block 1004.

At block 1004, the system can determine a cutter reference vector and/or a possible contact point of a shaped cutter on the drill bit. In some embodiments, the cutter reference vector can be determined based on a drill blade normal vector of a drill blade position on a drill blade surface that the shaped cutter is mounted on, wherein the drill blade position shares a same radial and axial position as a portion of the shaped cutter. For example, if a portion of the shaped cutter has a radial position of 40 centimeters, an axial position of 4 meters, and an azimuthal position of 270 degrees, the cutter reference vector can be based on the cutter centerline for a drill blade position at the radial position of 40 centimeters, the axial position of 4 meters, and an azimuthal position of 265 degrees or any other azimuthal position. By determining a cutter reference vector, the system can also determine the possible contact point for a shaped cutter attached to a drill blade based on a bit profile, wherein the cutter reference vector intersects the cutter boundary at the possible contact point for the shaped cutter.

In some embodiments, the system can determine a profile tilt vector based on a cutter contact point in a bit profile and use the profile tilt vector in place of the cutter reference vector. The bit profile of a drill bit can be a pre-determined design comprising lines and curves having different angles. Alternatively, the bit profile of the drill bit can include one or more points on a drill bit that is contact with a material being drilled through during a drilling operation. The bit profile can be determined based on information retrieved from a database. The bit profile can also be determined based on results from drilling experiments or a simulation of the rotating drill bit. For example, the area of engagement can be determined by drilling at a first drilling speed, wherein drilling at the first drilling speed corresponds with a threshold force detected on the shaped cutter, and wherein the position on the shaped cutter that experiences the greatest force can be the contact point of the engagement.

Alternatively, the contact point for each shaped cutter and its corresponding cutter reference vector can be determined based on information retrieved from a database, geometric analysis to determine the smoothest surface of the drill bit exterior, and/or a simulation of drill bit behavior to determine an area of engagement that includes the contact point. For example, with reference to FIG. 1, a simulation of the drill bit 100 drilling through shale can be analyzed to determine which surfaces of the drill bit 100 will be contact with shale during a drilling operation. In some embodiments, the bit profile can be determined based on a surface minimization method, wherein at least a portion of the bit profile is determined based on a minimization of a surface that is contact with outward-facing portions of the drill bit. For example, the surface minimization method can comprise using the system to calculate the shape of a surface that is in contact with one, some, or all of the drill bit cutters.

At block 1008, the system can determine a tilt angle and/or an off-centering distance for the shaped cutter based on the cutter reference vector and/or possible contact point. The tilt angle for the shaped cutter can be determined based on the angle between the cutter reference vector and a shaped cutter centerline. In some embodiments, the cutter reference vector and the shaped cutter centerline can be parallel and the corresponding tilt angle is zero. Alternatively, the cutter reference vector and the shaped cutter centerline can be non-parallel and the corresponding tilt angle is non-zero. In some alternative embodiments, the system can determine the tilt angle for the shaped cutter based on the profile tilt vector, wherein the tilt angle is based on the angle between the profile tilt vector and the shaped cutter centerline. Similarly, the system can determine the off-centering distance, wherein an off-centering distance is the distance along the partially flattened boundary of the shaped cutter from the possible contact point to the center of the partially flattened boundary. For example, with reference to FIG. 7, the off-centering distance for the leading tilted shaped cutter 710 can be the distance between the leading contact point 714 and the leading exposed partially flattened boundary center 719.

At block 1012, a determination is made if whether the tilt angle and/or off-centering distance is less than one or more thresholds. In some embodiments, a threshold can be a threshold tilt angle and can be a value greater than zero such as 0.5 degrees, 1 degree, 3 degrees, 5 degrees, 10 degrees, etc. In some embodiments, a threshold can be an offset threshold and the system can determine whether the off-centering distance of the contact point is less than the offset threshold. If the system determines that the off-centering distance is less than an off-centering threshold, the system can behave as if the tilt angle is below the threshold tilt angle. For example, the system can set the off-centering threshold to be the distance from the center of a partially flattened boundary to the upper edge of the partially flattened boundary. If the tilt angle and/or off-centering is less than the one or more thresholds, the system can proceed to block 1016. Otherwise, the operations of the flowchart 1000 can be considered complete.

At block 1016, the arrangement of the shaped cutter can be modified based on a pre-determined tilt angle. In some embodiments, modifying the arrangement of the shaped cutter can include tilting the shaped cutter on a drill blade in a virtual environment to increase the off-centering distance and change the possible contact point to a new contact point. In some embodiments, the drill bit having a shaped cutter arrangement can be modified to have the modified shaped cutter arrangement by a mechanical tilting operation of one or more shaped cutters on the drill bit to a pre-determined tilt angle to increase the off-centering distance and change the possible contact point to a new contact point. In some embodiments, the pre-determined tilt angle can be any value in either a clockwise or counter-clockwise direction. In some embodiments, the pre-determined tilt angle can be equal to or greater than the threshold tilt angle. For example, a shaped cutter can be tilted to have a tilt angle of 5 degrees clockwise from the reference angle, wherein a tilt angle equal to or greater than 5 degrees can reduce the possibility that cutter wear results in a repositioning of the contact point of the shaped cutter away from a side of a partially flattened boundary of the cutter during a drilling operation. Alternatively, a new drill bit can be generated to have the shaped cutters pre-tilted to have a tilt equal to the pre-determined tilt angle with respect to the cutter reference vector. In some embodiments, if the tilt angle was determined based on the profile tilt vector, the system can tilt the shaped cutter with respect to the profile tilt vector instead of the cutter reference vector. Once the cutter is tilted, operations of the flowchart 1000 can be complete.

Figure 11:
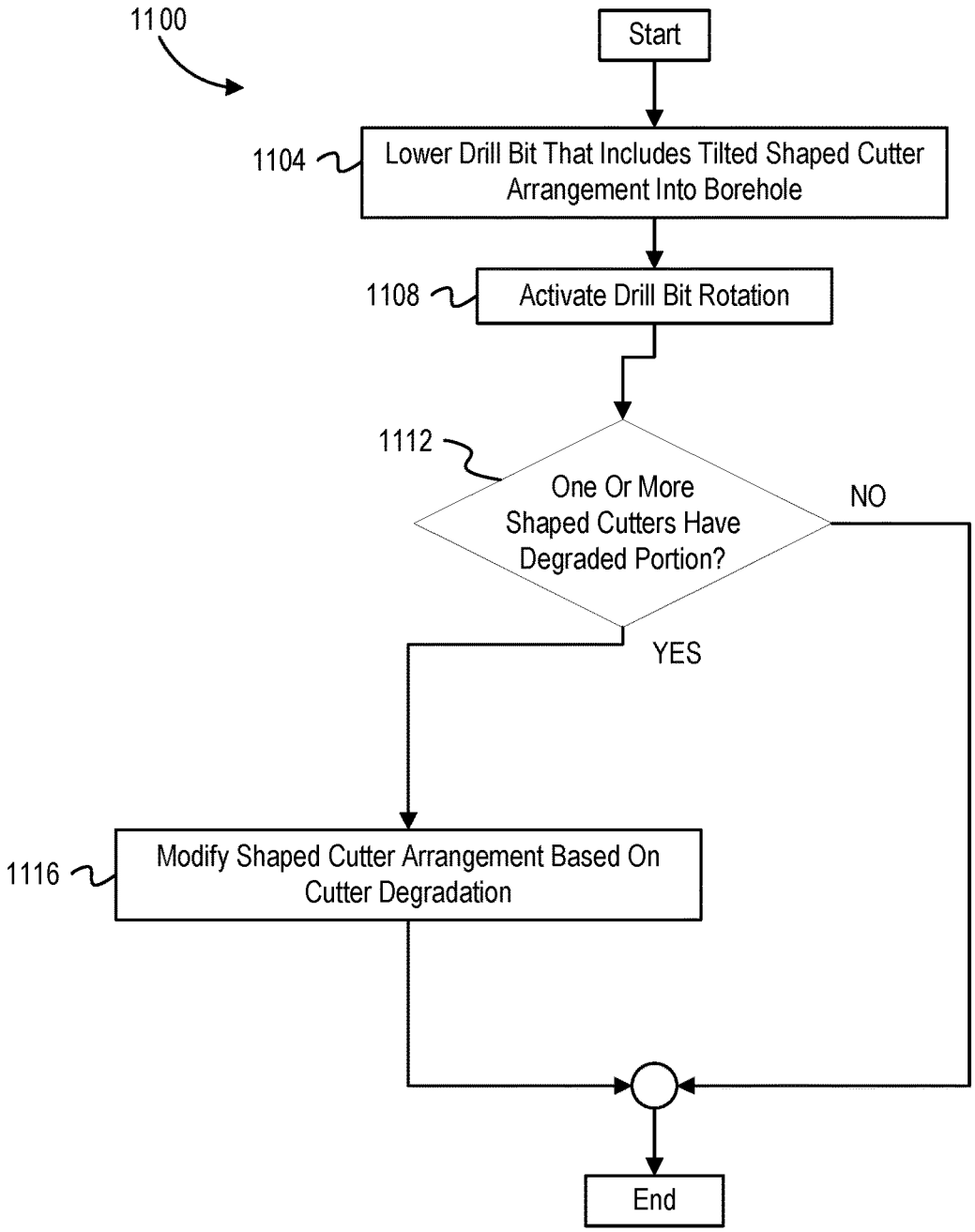
FIG. 11 is a flowchart of operations to operate a drill bit having a modified shaped cutter arrangement.

FIG. 11 is a flowchart of operations to operate a drill bit having a modified shaped cutter arrangement. FIG. 11 depicts a flowchart 1100 of operations to operate a drill bit having a modified shaped cutter arrangement using a system that includes a processor, wherein the operations can be performed using a system similar to the computer system 1298 or computer device 1300 shown in FIGS. 12 and 13, respectively. Operations of the flowchart 1100 start at block 1104.

At block 1104, the system lowers a drill bit that includes a tilted shaped cutter arrangement into a borehole. The system can lower the drill bit with the tilted shaped cutter arrangement during a drilling operation. In some embodiments, the drill bit can be used for extending a vertical or horizontal borehole. Alternatively, or in addition, the drill bit can be used to deepen a borehole of any orientation, and/or drill a branching well in a borehole. Alternatively, or in addition, the drill bit can include a step profile arrangement.

At block 1108, the system can activate drill bit rotation. In some embodiments, the system can activate drill bit rotation, perhaps by pumping drilling mud into a drill pipe to initiate rotation by a mud pump motor. For example, with reference to FIG. 12 below, the system can use the mud pump 1232 to rotate the drill bit 1226 during a drilling operation. During the drilling operation, the tilted shaped cutters and/or step profile arrangement can reduce the degradation of the shaped cutters.

At block 1112, a determination is made as to whether one or more shaped cutters on the drill bit have a degraded portion. In some embodiments, one more shaped cutters of the drill bit can be analyzed during or after a drilling operation to determine the condition of the one or more shaped cutters. The analysis can determine whether the one or more shaped cutters include degradation, such as blunting, cracking, or chipping over a portion of the shaped cutter. The analysis can be performed using various visual analysis methods, including image recognition methods. If the one or more shaped cutters on the drill bit have a degraded portion, operation of the flowchart 1100 can proceed to block 1116. Otherwise, operations of the flowchart 1100 can be considered complete.

At block 1116, the system can modify the shaped cutter arrangement of the drill bit based on the cutter degradation. The system can select one or more of the shaped cutters for a tilting operation. For example, with reference to FIG. 4, after a determination that a shaped cutter at the shaped cutter position 424 has experienced degradation, the system can select the shaped cutter at the shaped cutter position 424 for a tilting operation. The shaped cutter at the shaped cutter position 424 can then be mechanically tilted to a pre-determined tilt angle with respect to a cutter reference vector for the shaped cutter. Alternatively, the shaped cutter can be mechanically tilted to a pre-determined tilt angle with respect to a profile tilt vector for the shaped cutter. Once the system has modified the shaped cutter arrangement of the drill bit, operations of the flowchart 1100 can be considered complete.

Example Onshore Drilling Platform

Figure 12:
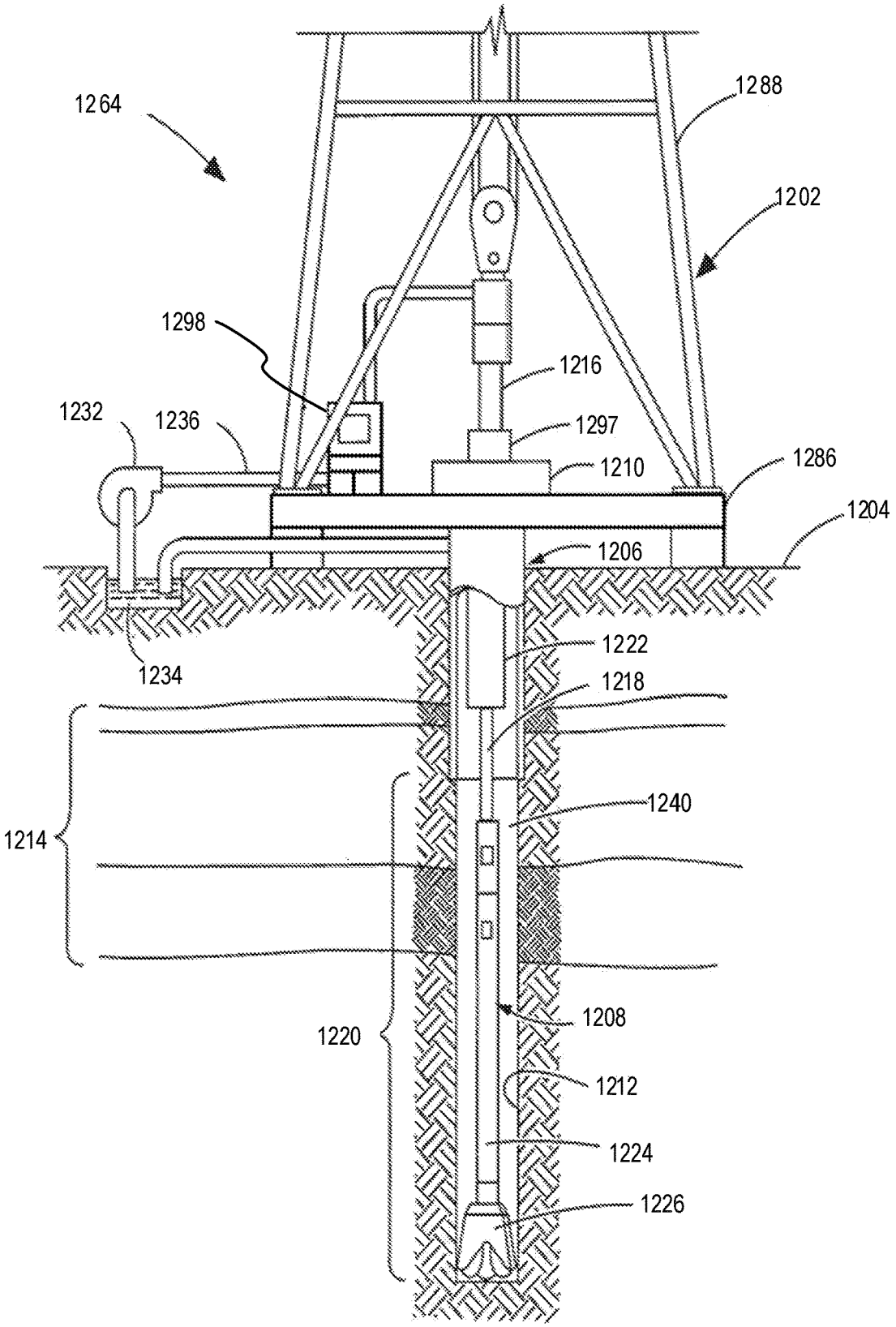
FIG. 12 is an elevation view of an onshore platform that includes a drill bit in a borehole.

FIG. 12 is an elevation view of an onshore platform that includes a drill bit in a borehole. FIG. 12 shows a system 1264 that includes a portion of a drilling rig 1202 located at the surface 1204 of a well 1206. Drilling of oil and gas wells is commonly carried out using a string of drill pipes connected together so as to form a drilling string 1208 that is lowered through a rotary table 1210 with support structure 1297 into a borehole 1212. Here a drilling platform 1286 is equipped with a derrick 1288 that supports a hoist.

The drilling rig 1202 may thus provide support for the drill string 1208. The drill string 1208 may operate to rotate the rotary table 1210 for drilling the borehole 1212 through subsurface formations 1214. The drill string 1208 may include a Kelly 1216, drill pipe 1218, and a bottom hole assembly 1220, perhaps located at the lower portion of the drill pipe 1218.

The bottom hole assembly 1220 may include drill collars 1222, a down hole tool 1224, and a drill bit 1226. The drill bit 1226 may operate to create a borehole 1212 by penetrating the surface 1204 and subsurface formations 1214. The down hole tool 1224 may comprise any of a number of different types of tools including measurement while drilling (MWD) tools, logging while drilling (LWD) tools, and others.

During drilling operations, the drill string 1208 (perhaps including the Kelly 1216, the drill pipe 1218, and the bottom hole assembly 1220) may be rotated by the rotary table 1210. In addition to, or alternatively, the bottom hole assembly 1220 may also be rotated by a motor such as a mud motor that is located down hole. The drill collars 1222 may be used to add weight to the drill bit 1226. The drill collars 1222 may also operate to stiffen the bottom hole assembly 1220, allowing the bottom hole assembly 1220 to transfer the added weight to the drill bit 1226, and in turn, to assist the drill bit 1226 in penetrating the surface 1204 and subsurface formations 1214. In some embodiments, the drill bit 1226 can include a modified shaped cutter arrangement comprising at least one of a tilted shaped cutter arrangement or a step profile arrangement. The computer system 1298 can perform some or all of the operations described above in the flowcharts in FIGS. 10 and 11.

During drilling operations, a mud pump 1232 may pump drilling fluid (sometimes known by those of ordinary skill in the art as "drilling mud") from a mud pit 1234 through a hose 1236 into the drill pipe 1218 and down to the drill bit 1226. The drilling fluid can flow out from the drill bit 1226 and be returned to the surface 1204 through an annular area 1240 between the drill pipe 1218 and the sides of the borehole 1212. The drilling fluid may then be returned to the mud pit 1234, where such fluid is filtered. In some embodiments, the drilling fluid can be used to cool the drill bit 1226, as well as to provide lubrication for the drill bit 1226 during drilling operations. Additionally, the drilling fluid may be used to remove subsurface formation 1214 cuttings created by operating the drill bit 1226.

Example Computer

Figure 13:
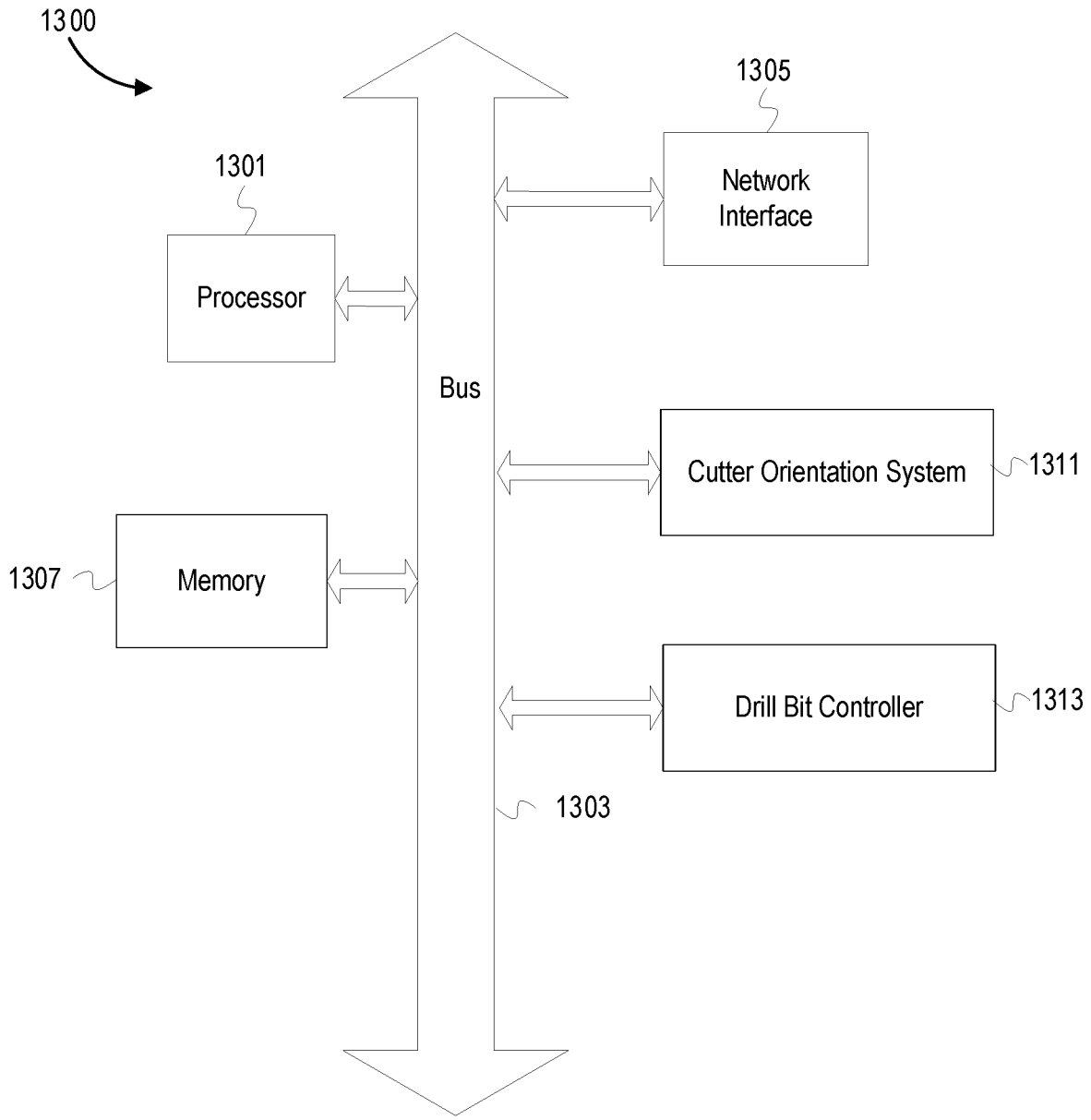
FIG. 13 depicts an example computer device.

FIG. 13 depicts an example computer device. A computer device 1300 includes a processor 1301 (possibly including multiple processors, multiple cores, multiple nodes, and/or implementing multi-threading, etc.). The computer device 1300 includes a memory 1307. The memory 1307 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 1300 also includes a bus 1303 (e.g., PCI, ISA, PCI-Express, HyperTransport® bus, InfiniBand® bus, NuBus, etc.) and a network interface 1305 (e.g., a Fiber Channel interface, an Ethernet interface, an internet small computer system interface, SONET interface, wireless interface, etc.).

The computer device 1300 can include a cutter orientation system 1311. The cutter orientation system 1311 can perform one or more operations to determine and/or set a shaped cutter arrangement as described above. For example, the cutter orientation system 1311 can determine a cutter reference vector of a shaped cutter on a drill bit and determine a tilt angle for a shaped cutter. Additionally, the cutter orientation system 1311 can determine whether a shaped cutter has a degraded portion. The cutter orientation system 1311 may operate by acquiring an image of the bit, and the associated cutters, to determine the orientation of the cutters, for example, whether the cutters are tilted or not tilted, and the degree of tilt, with respect to the longitudinal axis of the bit.

The computer device 1300 can include a drill bit controller 1313. The drill bit controller 1313 can perform one or more operations to control a drill bit as described above. For example, the drill bit controller 1313 can lower a drill bit during a drilling operation. Additionally, the cutter orientation system 1311 can activate a drill bit having tilted shaped cutters during the drilling operation. In addition, although illustrated together, the computer device 1300 can include the drill bit controller 1313 without the cutter orientation system 1311 or include the cutter orientation system 1311 without the drill bit controller 1313.

Any one of the previously described functionalities can be partially (or entirely) implemented in hardware and/or on the processor 1301. For example, the functionality can be implemented with an application specific integrated circuit, in logic implemented in the processor 1301, in a co-processor on a peripheral device or card, etc. Further, realizations can include fewer or additional components not illustrated in FIG. 13 (e.g., video cards, audio cards, additional network interfaces, peripheral devices, etc.). The processor 1301 and the network interface 1305 are coupled to the bus 1303. Although illustrated as being coupled to the bus 1303, the memory 1307 can be coupled to the processor 1301.

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit" or "system." The functionality presented as individual units in the example illustrations can be organized differently in accordance with any one of platform (operating system and/or hardware), application ecosystem, interfaces, programmer preferences, programming language, administrator preferences, etc.

Any combination of one or more machine readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

Terminology and Variations

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. A set of items can have only one item or more than one item. For example, a set of numbers can be used to describe a single number or multiple numbers.

Example Embodiments

Example embodiments include the following:

Embodiment 1: A device comprising: a drill bit body defining an axis of rotation; a plurality of drill blades on the drill bit body; and a shaped cutter secured to at least one of the plurality of drill blades, the shaped cutter including an engagement surface having an exposed partially flattened boundary, wherein a contact point of the engagement surface during drilling is off-centered with respect to a center of the exposed partially flattened boundary.

Embodiment 2: The device of Embodiment 1, wherein the shaped cutter is a leading shaped cutter, the contact point is a leading contact point, and wherein the device of claim 1 comprises a trailing shaped cutter comprising a trailing engagement surface, wherein a trailing contact point of the trailing engagement surface is at a different axial position from the leading contact point.

Embodiment 3: The device of Embodiment 2, wherein the leading contact point is at an upper end of the leading shaped cutter with respect to the axis of rotation and the trailing contact point is at a lower end of the trailing shaped cutter with respect to the axis of rotation.

Embodiment 4: The device of any of Embodiments 1-3, wherein a cutter centerline of the engagement surface is non-parallel with a drill blade normal vector, wherein the drill blade normal vector is normal to a point on the drill blade that the shaped cutter is mounted on, and wherein the point on the drill blade is at a same axial position and radial position as the shaped cutter.

Embodiment 5: The device of any of Embodiments 1-4, wherein the shaped cutter is a first shaped cutter, and wherein the exposed partially flattened boundary is a first exposed partially flattened boundary, and wherein the device of claim 1 comprises: a second shaped cutter attached to the drill bit body comprising a second exposed semi-flattened boundary, wherein the second shaped cutter has a second cutter centerline that is perpendicular to the second exposed semi-flattened boundary; and a third shaped cutter attached to the drill bit body comprising a third exposed semi-flattened boundary, wherein the third shaped cutter has a third cutter centerline that is perpendicular to the third exposed semi-flattened boundary, and wherein at least a portion of the third shaped cutter is at a different axial position along the axis of rotation, and wherein a distance from the axis of rotation to the second shaped cutter is equal to a distance from the axis of rotation to the third shaped cutter.

Embodiment 6: The device of any of Embodiments 1-5, wherein a minimum angle between a cutter centerline of the shaped cutter and a line from the center of the exposed partially flattened boundary to the contact point is greater than or equal to 5 degrees.

Embodiment 7: The device of any of Embodiments 1-6, wherein the shaped cutter is located at a bottom position of the drill bit body, and wherein a cutter centerline of the shaped cutter is at least 5 degrees offset from the axis of rotation.

Embodiment 8: The device of any of Embodiments 1-7, wherein the engagement surface comprises a polycrystalline diamond compact bit material.

Embodiment 9: A method comprising: determining a possible contact point on an exposed partially flattened boundary of a shaped cutter attached to a drill blade based on a bit profile; determining whether an off-centering distance of the contact point is less than an offset threshold; and in response to a determination that the off-centering distance is less than an off-centering threshold, tilting the shaped cutter to change the possible contact point to a new contact point.

Embodiment 10: The method of Embodiment 9, wherein determining whether the off-centering distance of the contact point is less than the offset threshold comprises determining the off-centering distance as the distance along the exposed partially flattened boundary from the possible contact point to a center of the exposed partially flattened boundary.

Embodiment 11: The method of Embodiments 9 or 10, wherein tilting the shaped cutter comprises tilting the shaped cutter until the off-centering distance is greater than or equal to the off-centering threshold.

Embodiment 12: The method of any of Embodiments 9-11, wherein the new contact point comprises a leading contact point, and wherein the method further comprises tilting a trailing shaped cutter to a trailing tilt angle, and wherein the trailing shaped cutter comprises a trailing contact point, and wherein at least a portion of the trailing shaped cutter is at a same axial position as the trailing shaped cutter, and wherein the trailing contact point is at a different axial position than the leading contact point.

Embodiment 13: The method of any of Embodiments 9-12, wherein tilting the shaped cutter comprises tilting the shaped cutter by an angle greater than 5 degrees.

Embodiment 14: A system comprising: a drill pipe in a borehole; a drill bit body defining an axis of rotation, wherein the drill bit body is in the borehole and attached to the drill pipe; a plurality of drill blades on the drill bit body; and a shaped cutter secured to at least one of the plurality of drill blades, the shaped cutter including an engagement surface having an exposed partially flattened boundary, wherein a contact point of the engagement surface during drilling is off-centered with respect to a center of the exposed partially flattened boundary.

Embodiment 15: The system of Embodiment 14, wherein the shaped cutter is a leading shaped cutter, the contact point is a leading contact point, and wherein the system further comprises a trailing shaped cutter with a trailing contact point, and wherein the trailing contact point is at a different axial position than the leading contact point.

Embodiment 16: The system of Embodiment 15, wherein the leading contact point is at an upper end of the leading shaped cutter with respect to the axis of rotation and the trailing contact point is at a lower end of the trailing shaped cutter with respect to the axis of rotation.

Embodiment 17: The system of any of Embodiments 14-16, wherein a cutter centerline of the engagement surface is non-parallel with a drill blade normal vector, wherein the drill blade normal vector is normal to a point on the drill blade that the shaped cutter is mounted on, and wherein the point on the drill blade is at a same axial position and radial position as the shaped cutter.

Embodiment 18: The system of any of Embodiments 14-17, wherein the shaped cutter is a first shaped cutter, and wherein the exposed partially flattened boundary is a first exposed partially flattened boundary, and wherein the system further comprises: a second shaped cutter attached to the drill bit body comprising a second exposed semi-flattened boundary, wherein the second shaped cutter has a second cutter centerline that is perpendicular to the second exposed semi-flattened boundary; and a third shaped cutter attached to the drill bit body comprising a third exposed semi-flattened boundary, wherein the third shaped cutter has a third cutter centerline that is perpendicular to the third exposed semi-flattened boundary, and wherein at least a portion of the third shaped cutter is at a different axial position along the axis of rotation, and wherein a distance from the axis of rotation to the second shaped cutter is equal to a distance from the axis of rotation to the third shaped cutter.

Embodiment 19: The system of any of Embodiments 14-18, wherein a minimum angle between a cutter centerline of the shaped cutter and the center of the exposed partially flattened boundary is greater than or equal to 5 degrees.

Embodiment 20: The system of any of Embodiments 14-19, wherein the shaped cutter is located at a bottom position of the drill bit body, and wherein a cutter centerline of the shaped cutter is at least 5 degrees offset from the axis of rotation.

What is claimed is:

1. A device comprising:

a drill bit body defining an axis of rotation;

a plurality of drill blades on the drill bit body, including a first drill blade; and a shaped cutter secured to the first drill blade at a tilt angle, the shaped cutter having a generally cylindrical like shape with a longitudinal axis, one end of the cylindrical like shape configured to be an engagement surface to encounter material during drilling, the engagement surface, prior to use, having a first boundary section and a second boundary section, the second boundary section separate from the first boundary section, the first boundary section having a first curvature, the second boundary section including an exposed partially flattened boundary having a second curvature, the second curvature less than the first curvature, the shaped cutter having a shaped cutter axis of rotation normal to the engagement surface and parallel to the longitudinal axis of the shaped cutter, the exposed partially flattened boundary having a center point that bisects the exposed partially flattened boundary, such that there is a shaped cutter centerline from the center point to the shaped cutter axis of rotation that is normal to the axis of rotation, the shaped cutter secured to the first drill blade at a tilt angle about the axis of rotation, such that when the drill bit is first put in use the shaped cutter is configured to have a contact point on the exposed partially flat boundary, separate from the center point, that is positioned to first encounter a material being drilled, wherein there is a cutter reference vector that is normal to the shaped cutter axis of rotation and that intersects the contact point, and wherein the cutter reference vector intersects the shaped cutter centerline at the shaped cutter axis of rotation, wherein the angle between the cutter reference vector and the shaped cutter centerline is approximately equal to the tilt angle.

2. The device of claim 1, wherein the shaped cutter is a leading shaped cutter and the contact point is a leading contact point, wherein the device of claim 1 further comprises a trailing shaped cutter secured to the first drill blade, the trailing shaped cutter comprising a trailing engagement surface, wherein a trailing contact point of the trailing engagement surface is at a different axial position from the leading contact point.

3. The device of claim 2, wherein the leading contact point is at an upper end of the leading shaped cutter with respect to the axis of rotation defined by the drill bit body and the trailing contact point is at a lower end of the trailing shaped cutter with respect to the axis of rotation defined by the drill bit body.

4. The device of claim 1, wherein the shaped cutter is a first shaped cutter, and wherein the exposed partially flattened boundary is a first exposed partially flattened boundary, and wherein the device of claim 1 further comprises:

a second shaped cutter attached to the drill bit body, the second shaped cutter comprising a second exposed partially flattened boundary, wherein the second shaped cutter has a second cutter centerline that is perpendicular to and bisects the second exposed partially flattened boundary; and a third shaped cutter attached to the drill bit body, the third shaped cutter comprising a third exposed partially flattened boundary, wherein the third shaped cutter has a third cutter centerline that is perpendicular to and bisects the third exposed partially flattened boundary, and wherein at least a portion of the third shaped cutter is at a different axial position along the axis of rotation defined by the drill bit body, and wherein a distance from the axis of rotation defined by the drill bit body to the second shaped cutter is equal to a distance from the axis of rotation defined by the drill bit body to the third shaped cutter.

5. The device of claim 1, wherein the tilt angle is greater than or equal to 5 degrees.

6. The device of claim 1, wherein the shaped cutter centerline is at an angle of at least 5 degrees offset from the cutter reference vector.

7. The device of claim 1, wherein the engagement surface comprises a polycrystalline diamond compact bit material.

8. In a drill bit body defining an axis of rotation and a plurality of drill blades that rotate around the axis of rotation, a method of installing a shaped cutter in one of the drill blades, the method comprising:

determining an initial position for securing the shaped cutter to the drill blade, the initial position establishing a first initial contact point on an exposed partially flattened boundary of an engagement surface of the shaped cutter, the first initial contact point the position on the exposed partially flattened boundary that first encounters a material being drilled when the shaped cutter is first used secured in the initial position;

selecting a second initial contact point on the exposed partially flattened boundary of the engagement surface of the shaped cutter, wherein the second initial contact point is not the first initial contact point;

determining whether an off-centering distance of the second initial contact point is less than an off-centering threshold, wherein the off-centering distance is a distance along the exposed partially flattened boundary from the second initial contact point to a center of the exposed partially flattened boundary; and in response to a determination that the off-centering distance is less than an off-centering threshold, rotating the shaped cutter by the off-centering distance to expose the second initial contact point as the position on the exposed partially flattened boundary that first encounters a material being drilled when the shaped cutter is first used secured in the drill blade as rotated.

9. The method of claim 8, wherein rotating the shaped cutter comprises rotating the shaped cutter until the off-centering distance is greater than or equal to the off-centering threshold.

10. The method of claim 8, wherein the second initial contact point comprises a leading contact point, and wherein the method further comprises rotating a trailing shaped cutter to a trailing tilt angle, and wherein the trailing shaped cutter comprises a trailing contact point, and wherein at least a portion of the trailing shaped cutter is at a same axial position as the trailing shaped cutter, and wherein the trailing contact point is at a different axial position than the leading contact point.

11. The method of claim 8, wherein rotating the shaped cutter comprises rotating the shaped cutter by an angle greater than 5 degrees around an axis of rotation extending through the engagement surface.

12. A system comprising:

a drill pipe in a borehole;

a drill bit body defining an axis of rotation, wherein the drill bit body is in the borehole and attached to the drill pipe;

a plurality of drill blades on the drill bit body, including a first drill blade; and a shaped cutter secured to the first drill blade at a tilt angle, the shaped cutter having a generally cylindrical like shape with a longitudinal axis, one end of the cylindrical like shape configured to be an engagement surface to encounter material during drilling, the engagement surface having, prior to use, a first boundary section and a second boundary section, the second boundary section separate from the first boundary section, the first boundary section having a first curvature, the second boundary section including an exposed partially flattened boundary having a second curvature, the second curvature less than the first curvature, the shaped cutter having a shaped cutter axis of rotation normal to the engagement surface and parallel to the longitudinal axis of the shaped cutter, the exposed partially flattened boundary having a center point that bisects the exposed partially flattened boundary at the center point, such that there is a shaped cutter centerline from the center point to the shaped cutter axis of rotation that is normal to the axis of rotation, the shaped cutter secured to the first drill blade at a tilt angle about the axis of rotation, such that when the drill bit is first put in use the shaped cutter is configured to have a contact point on the exposed partially flat boundary, separate from the center point, that is positioned to first encounter a material being drilled, wherein there is a cutter reference vector is that normal to the shaped cutter axis of rotation and that intersects the contact point, and wherein the cutter reference vector intersects the shaped cutter centerline at the shaped cutter axis of rotation, wherein the angle between the cutter reference vector and the shaped cutter centerline is approximately equal to the tilt angle.

13. The system of claim 12, wherein the shaped cutter is a leading shaped cutter and the contact point is a leading contact point, wherein the system further comprises a trailing shaped cutter secured to the first drill blade, the trailing shaped cutter having a trailing contact point, and wherein the trailing contact point is at a different axial position than the leading contact point.

14. The system of claim 13, wherein the leading contact point is at an upper end of the leading shaped cutter with respect to the axis of rotation defined by the drill bit body and the trailing contact point is at a lower end of the trailing shaped cutter with respect to the axis of rotation defined by the drill bit body.

15. The system of claim 12, wherein the shaped cutter is a first shaped cutter, wherein the exposed partially flattened boundary is a first exposed partially flattened boundary, and wherein the system further comprises:

a second shaped cutter attached to the drill bit body, the second shaped cutter comprising a second exposed partially flattened boundary, wherein the second shaped cutter has a cutter centerline that is perpendicular to and bisects the second exposed partially flattened boundary; and a third shaped cutter attached to the drill bit body, the third shaped cutter comprising a third exposed partially flattened boundary, wherein the third shaped cutter has a third cutter centerline that is perpendicular to and bisects the third exposed partially flattened boundary, and wherein at least a portion of the third shaped cutter is at a different axial position along the axis of rotation defined by the drill bit body, and wherein a distance from the axis of rotation defined by the drill bit body to the second shaped cutter is equal to a distance from the axis of rotation defined by the drill bit body to the third shaped cutter.

16. The system of claim 12, wherein the tilt angle is greater than or equal to 5 degrees.

17. The system of claim 12, wherein the shaped cutter centerline is at an angle of at least 5 degrees from the cutter reference vector.

* * * * *